US009735552B2

(12) United States Patent
Yamada et al.

(10) Patent No.: US 9,735,552 B2
(45) Date of Patent: Aug. 15, 2017

(54) SPARK PLUG

(71) Applicant: NGK Spark Plug Co., LTD., Nagoya (JP)

(72) Inventors: Tatsunori Yamada, Seto (JP); Yusuke Fuji, Iwakura (JP); Tomoyuki Igarashi, Kasugai (JP); Kei Takahashi, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 111 days.

(21) Appl. No.: 14/538,262

(22) Filed: Nov. 11, 2014

(65) Prior Publication Data

US 2015/0162725 A1 Jun. 11, 2015

(30) Foreign Application Priority Data

Nov. 12, 2013 (JP) ..... 2013-234456
Sep. 9, 2014 (JP) ..... 2014-183379

(51) Int. Cl.
*H01T 13/32* (2006.01)

(52) U.S. Cl.
CPC ..... *H01T 13/32* (2013.01)

(58) Field of Classification Search
CPC ..... H01T 13/32
USPC ..... 313/141
See application file for complete search history.

(56) References Cited

U.S. PATENT DOCUMENTS 3,958,144 A * 5/1976 Franks ..... H01T 13/14 313/118
4,808,878 A * 2/1989 Kashiwara ..... H01T 13/54 313/141
5,014,656 A * 5/1991 Leptich ..... H01T 13/32 123/169 EL
5,051,651 A * 9/1991 Kashiwara ..... H01T 13/32 313/139
5,430,346 A * 7/1995 Johnson ..... H01T 13/467 313/139
6,064,144 A 5/2000 Knoll et al.
(Continued)

FOREIGN PATENT DOCUMENTS

DE 3619938 A 12/1987
DE 10144976 A 4/2003
(Continued)

*Primary Examiner* — Joseph L Williams
*Assistant Examiner* — Christopher Raabe
(74) *Attorney, Agent, or Firm* — Leason Ellis LLP

(57) ABSTRACT

A spark plug includes: an insulator having an axial hole; a conductive member disposed around the insulator; a center electrode disposed inside the axial hole, having a bar shape extending in the axial direction, and located on a rear end side with respect to a front end of the conductive member; a ground electrode forming a spark gap between the ground electrode and the center electrode; and a connection part including a plurality of spokes extending in a radial direction whose inner ends are connected to the ground electrode, and connecting the conductive member to the ground electrode. The connection part includes a joint part that is jointed to an inner surface of the conductive member, and the ground electrode has at least one of a notch and a groove at a position that is different from a position connected to the spokes in a circumferential direction.

14 Claims, 8 Drawing Sheets

(56) References Cited

U.S. PATENT DOCUMENTS

| | | | | |
|---|---|---|---|---|
| 6,121,720 | A * | 9/2000 | Rossi | H01T 13/467 313/118 |
| 7,521,849 | B2 | 4/2009 | Havard et al. | |
| 8,044,560 | B2 * | 10/2011 | Steigleman, Jr. | H01T 13/20 313/118 |
| 2009/0096344 | A1 * | 4/2009 | Steigleman, Jr. | H01T 13/20 313/139 |
| 2009/0140623 | A1 * | 6/2009 | Ugalde | H01T 13/14 313/141 |
| 2011/0037373 | A1 * | 2/2011 | Nakamura | H01T 13/50 313/141 |
| 2011/0148274 | A1 * | 6/2011 | Ernst | H01T 13/467 313/141 |
| 2012/0125279 | A1 * | 5/2012 | Hampson | H01T 13/54 123/169 R |
| 2012/0299459 | A1 * | 11/2012 | Sakakura | H01T 13/32 313/141 |
| 2013/0206101 | A1 * | 8/2013 | Douglas | H01T 13/46 123/260 |
| 2016/0064903 | A1 * | 3/2016 | Deguchi | H01T 13/32 313/120 |

FOREIGN PATENT DOCUMENTS

| | | | |
|---|---|---|---|
| JP | 07-8568 | U | 2/1995 |
| JP | 2009-516326 | A | 4/2009 |
| JP | 2010-118236 | A | 5/2010 |
| JP | 2010-541178 | A | 12/2010 |
| JP | 2012-114077 | A | 6/2012 |
| WO | WO-2009/045209 | A | 4/2009 |

* cited by examiner

SPARK PLUG

This application claims the benefit of Japanese Patent Applications No. 2013-234456, filed Nov. 12, 2013 and No. 2014-183379, filed Sep. 9, 2014, all of which are incorporated by reference in their entities herein.

FIELD OF THE INVENTION

The present invention relates to a spark plug used for ignition in an internal combustion engine or the like.

BACKGROUND OF THE INVENTION

The spark plug used for ignition of a fuel gas in an internal combustion engine includes a center electrode and a ground electrode that are insulated to each other by an insulator. When a voltage is applied to the center electrode and the ground electrode, a spark discharge occurs in the clearance between the center electrode and the ground electrode, and the energy of that spark discharge causes the ignition to the fuel gas.

As an example, there has been known a spark plug including a cylindrical hollow ground electrode and a member for connecting the ground electrode to a metallic shell (for example, Patent Document 1). In this plug, the center electrode is arranged inside the cylindrical ground electrode, and a spark discharge occurs in the clearance between the outer circumference surface of the center electrode and the inner circumference surface of the ground electrode.

PRIOR ART DOCUMENT

Patent Document

[Patent Document 1] JP 2009-516326 W
[Patent Document 2] U.S. Pat. No. 6,064,144
[Patent Document 3] JP 2010-541178 W
[Patent Document 4] JP 2010-118236 A
[Patent Document 5] US 2011/0148274 A
[Patent Document 6] JP 7-008568 Y
[Patent Document 7] DE 3619938 A
[Patent Document 8] DE 10144976 A

Problem to be Solved by the Invention

However, since the front end portion including the center electrode and the ground electrode of the spark plug is exposed inside a high temperature combustion chamber, thermal expansion occurs in the members of the front end portion. As a result, there has been likelihood that a thermal stress due to the thermal expansion occurs in the members of the front end portion and therefore the spark plug is damaged.

An object of the present invention is to provide a technique of suppressing the damage on the spark plug due to the thermal stress occurring in the operation.

SUMMARY OF THE INVENTION

Means for Solving the Problems

The present invention has been made for overcoming at least a part of the above-described problem, and is applicable as the following application examples.

Application Example 1

A spark plug comprising:

an insulator having an axial hole extending in an axial direction;

a cylindrical conductive member disposed around the insulator;

a center electrode disposed inside the axial hole of the insulator, being a bar-shaped member extending in the axial direction, and located on a rear end side with respect to a front end of the conductive member;

a ground electrode forming a spark gap between the ground electrode and the center electrode; and a connection part including a plurality of spokes extending in a radial direction whose inner ends in the radial direction are connected to the ground electrode, and connecting the conductive member to the ground electrode, wherein the connection part includes a joint part jointed to an inner surface of the conductive member, and the ground electrode has at least one of a notch and a groove at a position in a circumferential direction that is different from a position in a circumferential direction connected to the plurality of spokes.

The thermal stress occurs due to the thermal expansion of the spokes and the ground electrode by the rise in temperature during the operation of the spark plug. This thermal stress may cause damage on the components (for example, the ground electrode or the connection part) of the spark plug. According to the above-described configuration, however, the ground electrode has at least one of the notch and the groove. As a result, the above-described thermal stress can be reduced, so that the damage on the spark plug due to the thermal stress can be suppressed.

Application Example 2

The spark plug according to the application example 1, wherein the ground electrode has the notch, and the notch and at least one of the spokes are disposed on a particular plane orthogonal to the axial direction, respectively.

According to this configuration, the thermal stress due to the thermal expansion of the spokes and the ground electrode can be effectively reduced by the notch arranged on the same plane as the spokes.

Application Example 3

The spark plug according to the application example 1 or 2, wherein the ground electrode has the notch, and a length in the axial direction of the notch is longer than half a length in the axial direction of the spoke, According to this configuration, the thermal stress due to the thermal expansion of the spokes and the ground electrode can be effectively reduced by the relatively large notch.

Application Example 4

The spark plug according to any one of the application examples 1 to 3, wherein the ground electrode has the notch, and an equation (1):

$$\frac{\sum_{n=1}^{K}\{S(n)\times L(n)\}}{\sum_{m=1}^{P}\{A(m)\times B(m)\times D\}}\leqq 2 \quad (1)$$

is satisfied, where the number of the spokes is denoted as K (K is a natural number greater than or equal to 2), a sectional area when an n-th spoke of the spokes is cut by a plane orthogonal to the radial direction is denoted as S(n) (n is a natural number less than or equal to K), and a length in the axial direction of the n-th spoke is denoted as L(n), the number of the notches is denoted as P (P is a natural number), a length in the axial direction of an m-th notch of the notches is denoted as A(m) (m is a natural number less than or equal to P), and a length in the circumferential direction of the m-th notch is denoted as B(m), and a thickness in the radial direction of the ground electrode is denoted as D.

According to this configuration, the ground electrode has the sufficiently large notch. Accordingly, the thermal stress due to the thermal expansion of the spokes and the ground electrode can be further effectively reduced.

Application Example 5

The spark plug according to the application example 1, wherein the ground electrode has the groove, and the groove extends along the axial direction from a front end to a rear end of the ground electrode.

According to this configuration, the thermal stress due to the thermal expansion of the spokes and the ground electrode can be effectively reduced by the relatively long groove.

Application Example 6

The spark plug according to the application example 1 or 5, wherein the ground electrode has the groove, and an equation (2):

$$\frac{\sum_{n=1}^{K}\{S(n)\times L(n)\}}{\sum_{m=1}^{P}[\{H\times E(m)\times F(m)\}\times(E(m)/D)]}\leqq 8 \quad (2)$$

is satisfied, where the number of the spokes is denoted as K (K is a natural number greater than or equal to 2), a sectional area when an n-th spoke of the spokes is cut by a plane orthogonal to the radial direction is denoted as S(n) (n is a natural number less than or equal to K), a length in the radial direction of the n-th spoke is denoted as L(n), an average value of lengths in the axial direction of the K spokes is denoted as H, the number of grooves is denoted as P (P is a natural number), a length in the circumferential direction of an m-th groove of the grooves is denoted as F(m) (m is a natural number less than or equal to P), and a depth in the radial direction of the m-th groove is denoted as E(m), and a thickness in the radial direction of the ground electrode is denoted as D.

According to this configuration, since the ground electrode has the sufficiently long groove, the thermal stress due to the thermal expansion of the spokes and the ground electrode can be further effectively reduced.

Application Example 7

The spark plug according to any one of application examples 1 to 6, wherein the joint part is formed by welding to the conductive member.

When the joint member and the conductive member are joined by welding, the reduction of the thermal stress may to be difficult. The above configuration, however, allows for effective reduction of the thermal stress by means of the notch and the groove.

Application Example 8

The spark plug according to any one of the application examples 1 to 7, wherein the ground electrode includes a portion having a cylindrical shape.

According to this configuration, the ground electrode includes the portion having the cylindrical shape, and thus a larger facing area of the ground electrode and the center electrode can be ensured. As a result, consumption of the ground electrode can be suppressed.

Application Example 9

The spark plug according to any one of the application examples 1 to 8, wherein the ground electrode includes a portion that is formed of a material whose thermal expansion coefficient is higher than that of the conductive member.

When the ground electrode includes a portion formed of the material whose thermal expansion coefficient is higher than that of the conductive member, the thermal stress tends to be large. According to the above configuration, however, the thermal stress that would otherwise tend to be large can be effectively reduced by the notch and the groove.

Application Example 10

The spark plug according to any one of the application examples 1 to 9, wherein the ground electrode includes a portion formed of a nickel alloy.

When the ground electrode includes a portion formed of the nickel alloy, the thermal stress tends to be large due to the relatively large thermal expansion coefficient of the nickel alloy. According to the above configuration, however, the thermal stress that would otherwise tend to be large can be effectively reduced by the notch and the groove.

Application Example 11

The spark plug according to any one of the application examples 1 to 10, wherein, for all of two adjacent spokes in the circumferential direction of the plurality of spokes, an angle between the two spokes is less than or equal to 180 degrees.

When the angle between the two spokes is less than or equal to 180 degrees for all the two spokes neighboring in the circumferential direction, a large thermal stress is likely to occur between the metallic shell and the spokes. Therefore, by forming the groove or the notch in the ground electrode, the thermal stress that would otherwise tend to be large can be effectively reduced.

Application Example 12

A spark plug comprising:

an insulator having an axial hole extending in an axial direction;

a cylindrical conductive member disposed around the insulator;

a center electrode disposed inside the axial hole of the insulator, being a bar-shaped member extending in the axial direction, and located on a rear end side with respect to a front end of the conductive member;

a ground electrode forming a spark gap between the ground electrode and the center electrode; and a connection part including a plurality of spokes extending in a radial direction whose inner ends in the radial direction are connected to the ground electrode, and connecting the conductive member to the ground electrode, wherein the connection part includes a joint part jointed to an inner surface of the conductive member, and the ground electrode has a buffer part for reducing a thermal stress caused by thermal expansion.

The thermal stress occurs due to the thermal expansion of the spokes or the ground electrode when the spark plug is used. This thermal stress may cause damage on the components (for example, the ground electrode or the connection part of the connection member) of the spark plug. According to the above-described configuration, however, the ground electrode has the buffer part for reducing the thermal stress, so that the damage on the spark plug due to the thermal stress can be suppressed.

It is noted that the present invention can be implemented in various forms, for example, can be implemented in the forms of the ground electrode for the spark plug, an ignition system in which the spark plug is mounted, an internal combustion engine in which the ignition system is mounted, and the like.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Description of Embodiments

A. First Embodiment

A-1. Configuration of the Spark Plug

Figure 1:
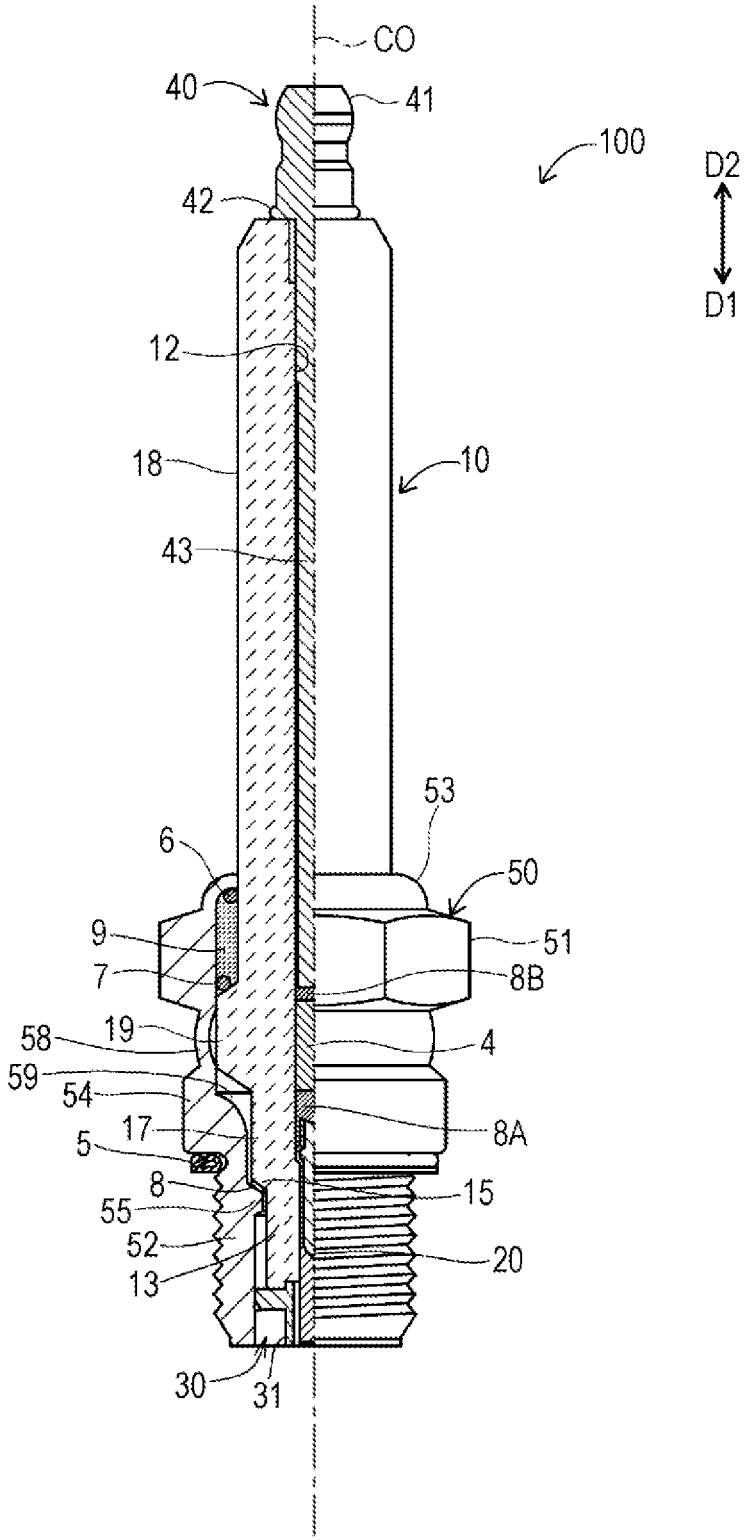
FIG. 1 is a cross-sectional view of a spark plug 100 of a first embodiment.

Embodiments of the present invention will be described below with reference to the drawings. FIG. 1 is a cross-sectional view of a spark plug 100 of a first embodiment. The dot-dash line of FIG. 1 represents an axial line CO of the spark plug 100 (also referred to as axial line CO). The direction parallel to the axial line CO (the vertical direction in FIG. 1) is also referred to as axial direction. The radial direction of a circle centered at the axial line CO is also simply referred to as "radial direction", and the circumferential direction of the circle centered at the axial line CO is also simply referred to as "circumferential direction". The downward direction in FIG. 1 is referred to as front end direction D1 and the upward direction is referred to as rear end direction D2. The lower side in FIG. 1 is referred to as front end side of the spark plug 100 and the upper side in FIG. 1 is referred to as rear end side of the spark plug 100.

The spark plug 100 is used in, for example, an internal combustion engine such as a gasoline engine of an automobile, or a gas engine used in a cogeneration system or a heat pump. The spark plug 100 includes an insulator 10 as an insulator, a center electrode 20, an insertion member 30 including a ground electrode 31, a terminal metal shell 40, and a metallic shell 50.

The insulator 10 is formed by sintering alumina or the like. The insulator 10 extends along the axial direction and is a member of substantially a cylindrical shape (a cylindrical member) having a through hole 12 (also referred to as axial hole) penetrating the insulator 10. The insulator 10 has a flange part 19, a rear-end-side trunk part 18, a front-end-side trunk part 17, a step part 15, and a nose part 13. The rear-end-side trunk part 18 is located on the rear end side of the flange part 19 and has a smaller diameter than the outer diameter of the flange part 19. The front-end-side trunk part 17 is located on the front end side of the flange part 19 and has a smaller diameter than the outer diameter of the rear-end-side trunk part 18. The nose part 13 is located on the front end side of the front-end-side trunk part 17 and has a smaller diameter than the outer diameter of the front-end-side trunk part 17. The nose part 13 has substantially a cylindrical shape. On a front end surface 13A of the nose part 13, a recess part 131 to which the rear end portion of the ground electrode 31 described later is fitted is formed. When the spark plug 100 is mounted in the internal combustion engine (not illustrated), the nose part 13 is exposed in a combustion chamber of the internal combustion engine. The step part 15 is formed between the nose part 13 and the front-end-side trunk part 17.

The metallic shell 50 is a member of substantially a cylindrical shape (a cylindrical member) that is formed of a conductive metal material (specifically, a low-carbon steel material) for fixing the spark plug 100 to an engine head (illustration is omitted) of the internal combustion engine. In the metallic shell 50, a through hole 59 penetrating it along the axial line CO is formed. The metallic shell 50 is arranged around the insulator 10. That is, the insulator 10 is inserted and held inside the through hole 59 of the metallic shell 50. The front end of the insulator 10 is located in the rear end direction D2 side of the front end of the metallic shell 50. The rear end of the insulator 10 is exposed out of the rear end of the metallic shell 50.

The metallic shell 50 has a hexagonal-cylindrical tool engagement part 51 to which a spark plug wrench is engaged, a mounting screw part 52 for installation to the internal combustion engine, and a flange-like seat part 54 formed between the tool engagement part 51 and the mounting screw part 52. Here, the nominal diameter of the mounting screw part 52 is any one of M10 (10 mm (millimeter)), M12, M14, M18, M20, and M24, for example.

An annular gasket 5 that is formed by bending a metal sheet is inserted and fitted between the mounting screw part 52 and the seat part 54 of the metallic shell 50. The gasket 5 seals the clearance between the spark plug 100 and the internal combustion engine (the engine head) when the spark plug 100 is installed to the internal combustion engine.

The metallic shell 50 further has a thin crimp part 53 provided to the rear end side in the tool engagement part 51, and a thin compression deformation part 58 provided between the seat part 54 and the tool engagement part 51. Annular ring members 6 and 7 are arranged in the annular area formed between the inner circumference surface of the portion from the tool engagement part 51 up to the crimp part 53 of the metallic shell 50 and the outer circumference surface of the rear-end-side trunk part 18 of the insulator 10. Powder of talc (talcum) 9 is filled between the two annular members 6 and 7 in that area. Further, the mounting screw part 52 of the metallic shell 50 has a shelf part 55 protruding toward the inner circumference side of the mounting screw part 52.

The rear end of the crimp part 53 is bent inward in the radial direction and fixed to the outer circumference surface of the insulator 10. The compression deformation part 58 of the metallic shell 50 is compressed and deformed at the manufacturing by that the crimp part 53 fixed to the outer circumference surface of the insulator 10 is pressed toward the front end side. The compression deformation of the compression deformation part 58 causes the insulator 10 to be pressed toward the front end side within the metallic shell 50 via the annular members 6 and 7 and the talc 9. As a result, the step part 15 of the insulator 10 is pressed to the shelf part 55 of the metallic shell 50 via an annular plate packing 8. That is, the shelf part 55 and the step part 15 are sealed interposing the plate packing 8. As a result, the plate packing 8 prevents the gas inside the combustion chamber of the internal combustion engine from being leaked out from the clearance between the metallic shell 50 and the insulator 10. The plate packing 8 is formed of a metal such as iron and the like, for example.

While the details of the configuration around the front end part of the spark plug 100 will be described later, the center electrode 20 is a bar-shaped member extending along the axial line CO, and arranged inside near the front end of the through hole 12 of the insulator 10. The front end of the center electrode 20 is exposed out of the front end of the insulator 10 (FIG. 1). The insertion member 30 including the ground electrode 31 is inserted in the through hole 59 of the metallic shell 50 from the front end direction D1 side of the metallic shell 50.

The terminal metal shell 40 is a bar-shaped member extending along the axial line CO. The terminal metal shell 40 is formed of a conductive metal material (for example, a low-carbon steel) and, on its surface, an anti-corrosion metal layer (for example, an Ni layer) is formed by a plating and the like. The terminal metal shell 40 has a flange part 42 (a terminal flange part) formed to a predetermined position in the axial direction, a cap mounting part 41 located at a rear end side of the flange part 42, and a nose part 43 (a terminal nose part) located in the front end side of the flange part 42. The cap mounting part 41 including the rear end of the terminal metal shell 40 is exposed to the rear end side of the insulator 10. The nose part 43 including the front end of the terminal metal shell 40 has been inserted (press-fitted) in the through hole 12 of the insulator 10 from the rear end direction D2 side. To the cap mounting part 41, a plug cap connected with a high-voltage cable (out of the drawing) is mounted and a high voltage for generating the spark is applied.

Inside the through hole 12 of the insulator 10, a resistor element 4 for reducing the electromagnetic noise at the spark generation is arranged in the area between the front end of the terminal metal shell 40 and the rear end of the center electrode 20. The resistor element 4 is formed of a composition containing glass particles that are the primary component, ceramic particles other than the glass, and a conductive material, for example. The clearance between the resistor element 4 and the center electrode 20 inside the through hole 12 is filled with a conductive seal 8A, and the clearance between the resistor element 4 and the terminal metal shell 40 is filled with a conductive seal 8B made of glass and metal.

A-2: Configuration Around the Front End of the Spark Plug 100

Figure 2:
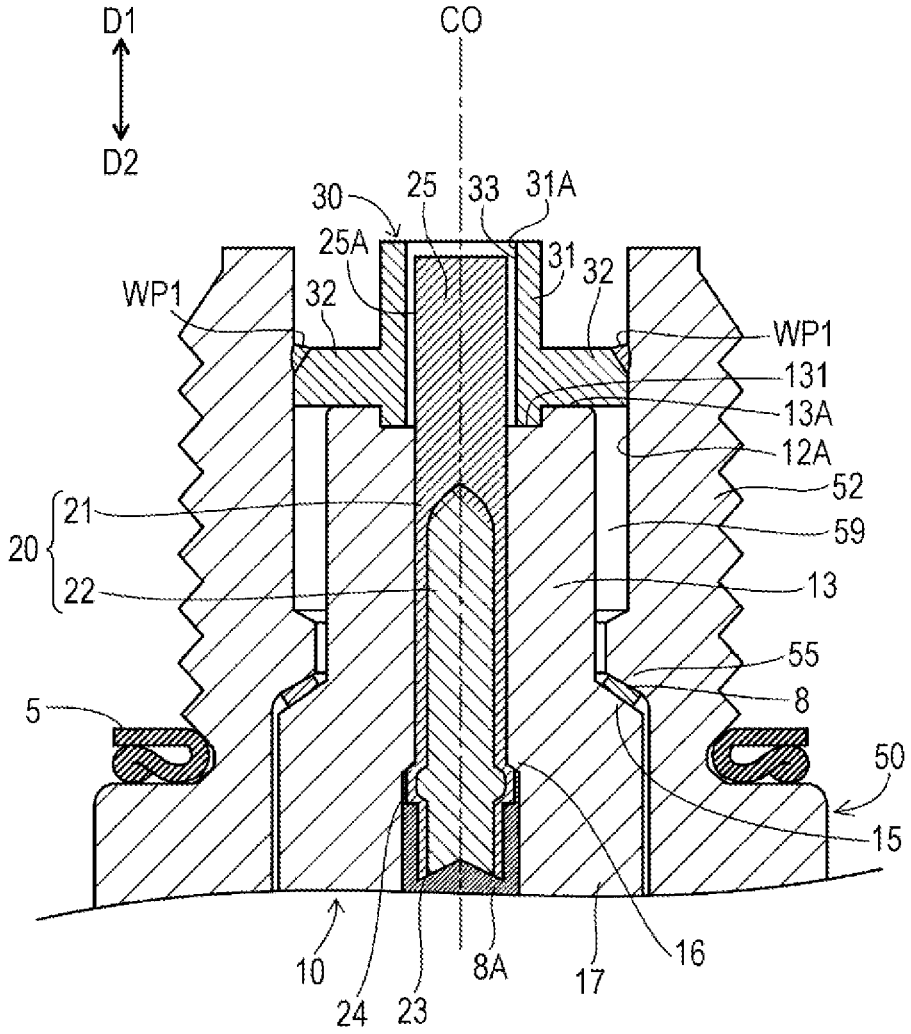
FIG. 2 is a cross-sectional view of the vicinity of a front end of the spark plug 100.

FIG. 2 is a cross-sectional view of the vicinity of the front end of the spark plug 100. By referring to FIG. 2, the configuration around the front end of the spark plug 100 will be described in more detail. The cross section in FIG. 2 is a cross section of the spark plug 100 cut by a plane including the axial line CO.

The center electrode 20 has construction including an electrode base material 21 and a core material 22 buried inside the electrode base material 21 (FIG. 2). The electrode base material 21 is formed of nickel or an alloy whose primary component is nickel (the Inconel™ 600 or the like). The core material 22 is formed of copper or an alloy whose primary component is copper that is superior in the thermal conductivity to the alloy forming the electrode base material 21.

The center electrode 20 has a flange part 24 (also referred to as electrode flange part or flange part) provided to a predetermined position in the axial direction, a head part 23 (an electrode head part) that is a portion in the rear end side of the flange part 24, and a nose part 25 (an electrode nose part) that is a portion in the front end side of the flange part 24. The flange part 24 is supported by a step part 16 of the insulator 10. The nose part 25 of the center electrode 20 has a cylindrical shape. The center electrode 20 is located in the rear end side of the front end of the metallic shell 50. That is, the front end of the metallic shell 50 is located in the front end direction D1 of the front end of the nose part 25 of the center electrode 20.

The insertion member 30 has the ground electrode 31 and a plurality of (for example, four) spokes 32 connecting the metallic shell 50 to the ground electrode 31. The ground electrode has substantially a cylindrical shape. The inner circumference surface of the ground electrode 31 is a gap forming surface 31A. That is, the front end portion of the nose part 25 of the center electrode 20 is arranged inside a hole 33 formed by the gap forming surface 31A of the ground electrode 31. As a result, an outer circumference surface 25A of the front end portion of the nose part 25 of the center electrode 20 and the gap forming surface 31A of the ground electrode 31 face to each other in the direction orthogonal to the axial line CO and form a spark gap. The outer circumference surface 25A of the front end portion of the nose part 25 is also referred to as gap forming surface 25A.

The insertion member 30 is inserted in the through hole 59 from the front end side of the through hole 59 of the metallic shell 50 and arranged at a portion formed in the mounting screw part 52 of the through hole 59. The rear end portion of the insertion member 30 is supported by the front end of the nose part 13. That is, the rear end surfaces of the four spokes 32 of the insertion member 30 are in contact with the front end surface 13A of the nose part 13. Further, a rear end part 315 of the ground electrode 31 of the insertion member 30 is fitted in the above-described recess part 131 formed in the nose part 13. The outer ends in the radial direction of the front-end-side surfaces of the spokes 32 are welded to an inner circumference surface 12A of the mounting screw part 52 of the metallic shell 50 by laser welding. That is, welded parts WP1 formed by the laser welding are formed between the outer ends in the radial direction of the spokes 32 and the inner circumference surface 12A of the mounting screw part 52 of the metallic shell 50. The plurality of (for example, four) spokes 32 may be also referred to as connection parts connecting the metallic shell 50 to the ground electrode 31. The welded parts WP1 are formed to the outer edges of the spokes 32, and may be also referred to as joint parts jointed to the inner circumference surface 12A of the metallic shell 50.

The insertion member 30, that is, the ground electrode 31 and the spokes 32 are formed of a metal having a high anti-corrosion property, for example, a nickel alloy such as the inconel 600 and the like similarly to the electrode base material 21 of the center electrode 20. The nickel alloy forming the insertion member 30 is a material having a higher thermal expansion, that is, having a larger thermal expansion coefficient than the metal material forming the metallic shell 50 (for example, a low-carbon steel material).

Figure 3:
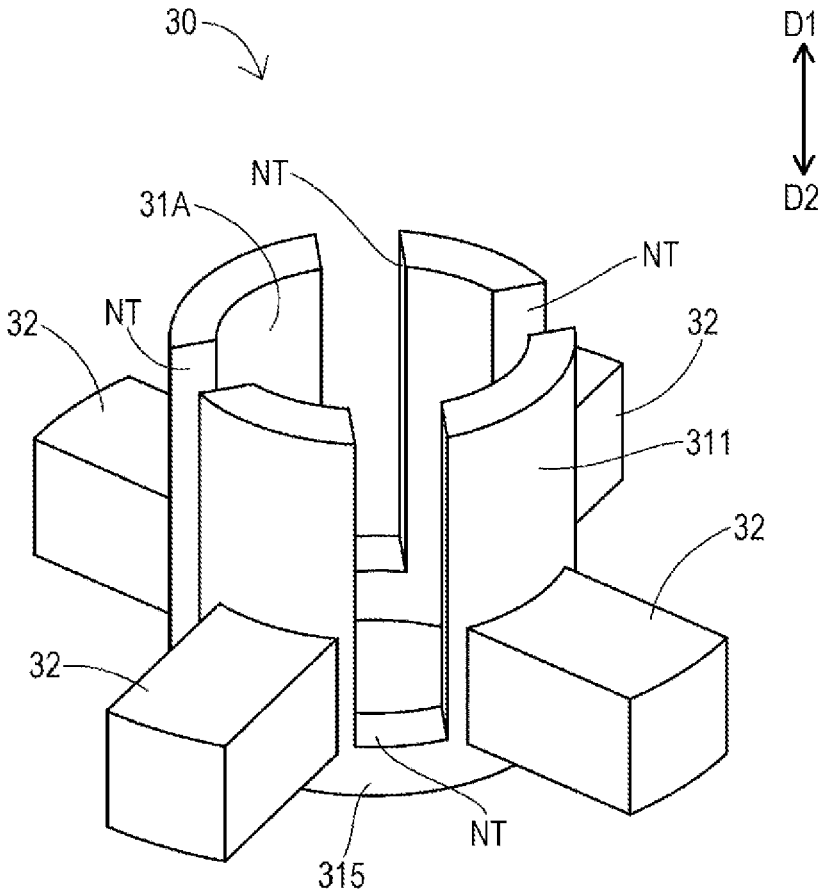
FIG. 3 is a perspective view of an insertion member 30 of the first embodiment.
Figure 4A:
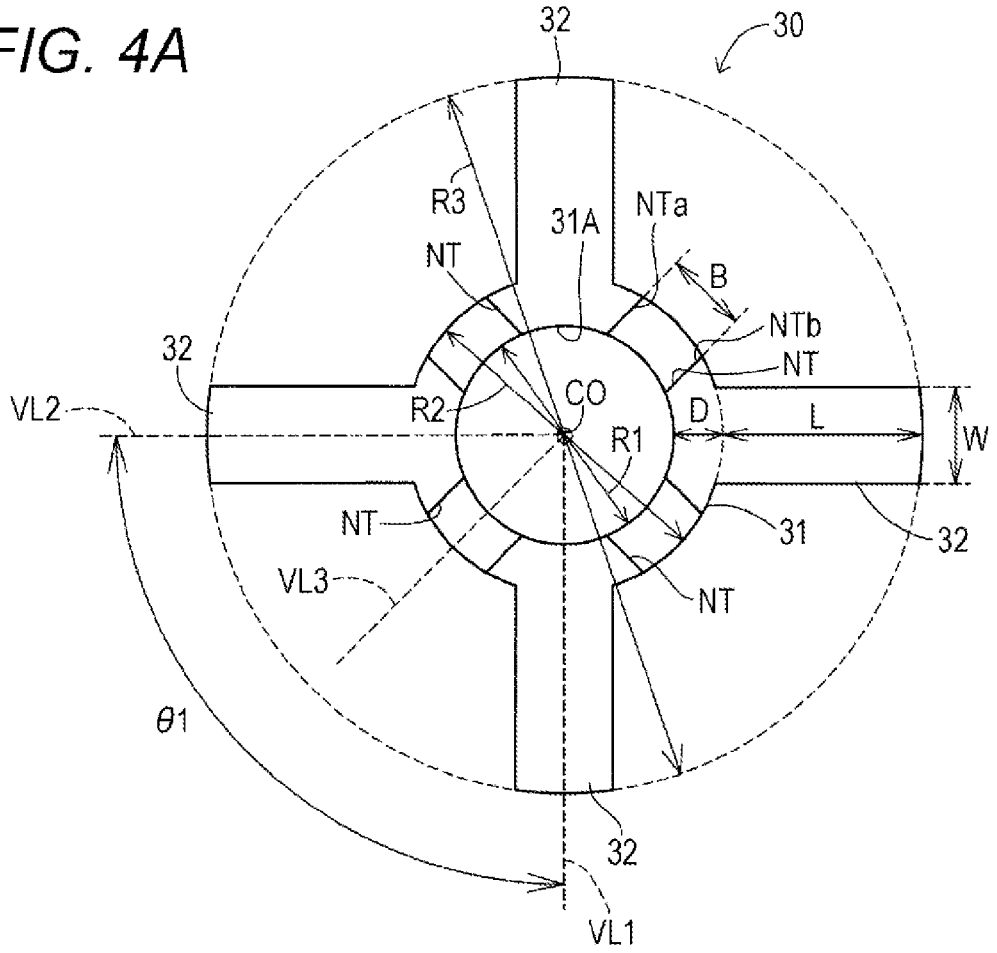
FIG. 4A is an external view and FIG. 4B is a cross-sectional view of the insertion member 30 of the first embodiment.
Figure 4B:
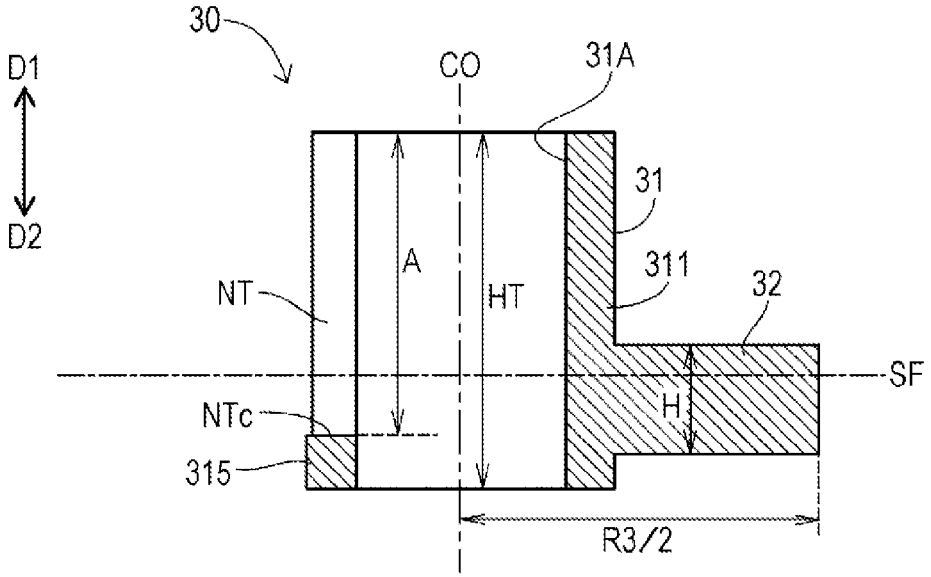

By referring to FIG. 3, FIG. 4A and FIG. 4B, the insertion member 30 will be further described in more detail. FIG. 3 is a perspective view of the insertion member 30. FIG. 4A is a view of the insertion member 30 viewed from the rear end side toward the front end direction D1. FIG. 4B is a cross-sectional view cutting the insertion member 30. The right portion of the axial line CO of the sectional view of FIG. 4B illustrates a cross section of the insertion member 30 cut by a cross section including a virtual line VL1 of FIG. 4A and the axial line CO. The left portion of the axial line CO of the sectional view of FIG. 4B illustrates a cross section of the insertion member 30 cut by a cross section including a virtual line VL3 of FIG. 4A and the axial line CO.

A length H in the axial direction of the spoke 32 is shorter than a length HT in the axial direction of the ground electrode 31 (FIG. 4B). In the examples of FIG. 3, FIG. 4A and FIG. 4B, the length HT is approximately two to three times the length H. In these examples, the position in the axial direction of the spokes 32 is the position that is in the rear end side with respect to the center in the axial direction of the ground electrode 31. That is, the front end surface of the ground electrode 31 protrudes in the front end direction D1 with respect to the front end surfaces of the spokes 32. Further, the rear end surface of the ground electrode 31 protrudes slightly in the rear end direction D2 with respect to the rear end surfaces of the spokes 32. The portion of the ground electrode 31 that protrudes in the rear end direction D2 with respect to the rear end surface of the spokes 32 is the rear end part 315 that fits in the above-described recess part 131 of the nose part 13.

Here, the number of the spokes 32 is denoted as K (K is a natural number greater than or equal to 2, and it is four in the examples of FIG. 3, FIG. 4A and FIG. 4B). In FIG. 4A, a diameter R3 of a virtual circle VC that passes outside in the radial direction of the K spokes 32 and is centered at the axial line CO is slightly smaller (for example, by 0.1 mm) than the inner diameter of the above-described inner circumference surface 12A of the mounting screw part 52 of the metallic shell 50 (FIG. 2).

Each of the spokes 32 extends along the radial direction. The cross section cut by a plane orthogonal to the radial direction of each spoke 32 is a rectangle in the examples of FIG. 3 to FIG. 4B. That is, the spoke 32 has a square bar shape having a length L in the radial direction. By using a length W in the circumferential direction of each spoke 32 and a length H in the axial direction of the spoke 32, a sectional area S of each spoke 32 can be expressed by H×W. The sectional area S is an area of a cross section of one spoke cut by a plane orthogonal to the radial direction.

The inner end in the radial direction of each spoke 32 is in contact with the outer circumference surface of the ground electrode 31. Therefore, as illustrated in FIG. 4A, the radial direction length L of each spoke 32 is half the diameter difference between the above-described diameter R3 of the virtual circle VC and an outer diameter R2 of the ground electrode 31 (L=(R3−R2)/2).

The K spokes 32 are arranged in the positions in the circumference direction each being apart by an angle θ1, for example. That is, the angle made by two spokes 32 neighboring in the circumferential direction is expressed by θ1=(360/K), for example. In the examples of FIG. 3 and FIG. 4A, since K=4, 01=90 degrees. (FIG. 4A). For example, the angle made by two spokes 32 can be expressed by the angle between the virtual line VL1 and a virtual line VL2. The virtual lines VL1 and VL2 are virtual lines that extend outward the circumferential direction from the axial line CO and pass the center in the circumferential direction of the two spokes 32, respectively (FIG. 4A).

The ground electrode 31 has a cylindrical shape whose height in the axial direction is HT. The ground electrode 31 has P notches NT (P is a natural number, and it is four in the examples of FIG. 3, FIG. 4A and FIG. 4B) formed in the front-end-side portion. The position in the circumferential direction where the notches NT are formed is different from the position in the circumferential direction where the ground electrode 31 is in contact with each spoke 32. In the examples of FIG. 3, FIG. 4A and FIG. 4B, each notch NT is formed in the center of two spokes 32 neighboring to each other in the circumferential direction.

In other words, the ground electrode 31 has the above-described cylindrical rear end part 315 where no notch NT is formed and a portion 311 where P notches are formed that is located in the front end side of the rear end part 315 (hereafter, also referred to as "front end part 311") (FIG. 3, FIG. 4B). Further, as illustrated in FIG. 2, the inner circumference surfaces of the rear end part 315 and the front end part 311 both face the outer circumference surface 25A of the center electrode 20 and form the spark gap. In addition, it can be said that the cylindrical part 315 with no notch NT formed is the cylindrical part 315 that is continuous over the entire circumference in the circumferential direction.

Among surfaces NTa, NTb, and NTc of the ground electrode 31 that form the notch NT (FIGS. 4A, B), two surfaces NTa and NTb that are parallel to the axial line CO are parallel to each other in the examples of FIG. 3, FIG. 4A and FIG. 4B. Further, the surface NTc of the ground electrode 31 forming the front end side in the notch NT is orthogonal to the axial line CO. A length B in the circumferential direction of the notch NT is expressed by the distance between two surfaces NTa and NTb. Further, a length A in the axial direction of the notch NT is expressed by the distance from the front end of the ground electrode 31 to the surface NTc. It can be said that the length in the radial direction of the notch NT is equal to a thickness D in the radial direction of the ground electrode 31. In the examples of FIG. 3, FIG. 4A and FIG. 4B, the axial direction length A of the notch NT is longer than the axial direction length H of the spoke 32.

As illustrated in FIG. 4A, the radial direction thickness D of the ground electrode 31 is half the diameter difference between the outer diameter R2 of the ground electrode 31 (the outer diameter of the cylindrical part 315) and the inner diameter R1 of the ground electrode 31 (the inner diameter of the cylindrical part 315) (D=(R2−R1)/2). It can be said that the radial direction thickness D of the ground electrode 31 is the radial direction thickness D of the notch NT.

As illustrated in FIG. 4B, the range in the axial direction where the notch NT is formed (the range of the length A of FIG. 4B) overlaps the range in the axial direction where the spoke 32 is located (the range of the length H of FIG. 4B). That is, the notch NT and the spoke 32 are arranged on a particular plane orthogonal to the axial line CO (for example, a plane SF of FIG. 4B), respectively. More specifically, the front end of the notch NT is located in the front end direction D1 with respect to the front end surface of the spoke 32 and the rear end of the notch NT is located near the rear end surface of the spoke 32.

The operation of the above-described spark plug 100 will be described. The spark plug 100 is mounted and used in the internal combustion engine such as a gas engine and the like. A voltage is applied between the ground electrode 31 and the center electrode 20 of the spark plug 100 by an ignition system including a predetermined power source (for example, a full-transistor ignition system). As a result, a spark discharge occurs at the spark gap formed between the gap forming surface 31A of the ground electrode 31 and the gap forming surface 25A of the center electrode 20. The combustion gas within the combustion chamber of the internal combustion engine is ignited by the spark discharge.

As mentioned above, the front end part of the spark plug 100 is exposed inside the combustion chamber of the internal combustion engine. Thus, the combustion of the fuel gas by the operation of the spark plug 100 causes a rise in the temperature of the members in the front end part of the spark plug 100, in particular, the insertion member 30 including the ground electrode 31 and the spokes 32 due to the combustion energy. Therefore, during the operation of the internal combustion engine, that is, during the operation of the spark plug 100, the temperature of the insertion member 30 of the spark plug 100 becomes significantly higher than that when the operation of the spark plug 100 is stopped. On the other hand, since the mounting screw part 52 of the metallic shell 50 is in contact with the engine head that is cooled by water cooling and the like, the temperature thereof does not become high compared to that of the insertion member 30.

Such a rise in the temperature during the operation of the spark plug 100 causes the spokes 32 and/or the ground electrode 31 to thermal-expand. There is likelihood that the thermal stress occurring due to the thermal expansion causes damage on the components of the spark plug 100. For example, when the operation state and the stop state of the spark plug 100 are repeated, the radial direction length L of the spokes 32 repeatedly changes due to the thermal expansion. This causes the thermal stress to be repeatedly applied to the welding parts WP1 (FIG. 4B) that joint the outer end parts in the radial direction of the spokes 32 and the inner circumference surface 12A of the metallic shell 50. Further, as described above, since the temperature of the mounting screw part 52 of the metallic shell 50 does not become higher than that of the insertion member 30, its thermal expansion is smaller than that of the insertion member 30. In this way, the difference in the thermal expansion between the mounting screw part 52 and the insertion member 30 also causes the increase in the thermal stress applied to the welding parts WP1. As a result, there is likelihood that a crack occurs in the welding parts WP1.

In the spark plug 100 of the above-described first embodiment, the notches NT are formed in the ground electrode 31. Thereby, the bending of the front end part 311 of the ground electrode 31 is facilitated. As a result, for example, even when the radial direction length L of the spokes 32 changes due to the thermal expansion, the slight bending of the front end part 311 of the ground electrode 31 allows for the effective reduction of the thermal stress caused by the thermal expansion. Therefore, this allows for the suppression of the damage on the spark plug 100, for example, the occurrence of the crack in the welding parts WP1 due to the thermal stress. As a result, the durability property of the spark plug 100 can be improved.

Further, as described above, in the spark plug 100 of the above-described first embodiment, the notches NT and the spokes 32 are arranged on a particular plane orthogonal to the axial direction (for example, the plane SF (FIG. 4B)), respectively. As a result, the thermal stress due to the thermal expansion of the spokes 32 and/or the ground electrode 31 can be effectively reduced by the notches NT arranged on the same plane as the spokes 32. Specifically, as described above, the thermal stress is mainly caused by the change in the radial direction length L of the spokes 32 due to the thermal expansion. Therefore, when the spokes 32 and the notches NT of the ground electrode 31 are arranged on a particular plane orthogonal to the axial line CO (that is, a particular plane parallel to any radial direction), this facilitates the bending of the front end part 311 on the particular plane of the ground electrode 31. As a result, the thermal stress caused by the thermal expansion can be effectively reduced.

Furthermore, in the spark plug 100 of the above-described first embodiment, the axial direction length A of the notch NT (FIG. 4B) is sufficiently long with respect to the axial direction length H of the spoke 32. Specifically, the length A is longer than the length H. The longer the axial direction length A of the notch NT is, the larger the notch NT is. As a result, the sufficiently large notches NT allow for the effective reduction of the thermal stress caused by the thermal expansion.

Furthermore, the ground electrode 31 includes the cylindrical part 315. In other words, the ground electrode 31 is not separated into multiple pieces. For example, if clearances having the same circumferential direction length B as the notches NT were formed in place of the notches NT, the ground electrode 31 would be separated into multiple pieces. Since the ground electrode 31 includes the cylindrical part 315, however, the excessive reduction in the rigidity of the ground electrode 31 can be suppressed. As a result, for example, the change in the spark gap can be suppressed while the thermal stress is reduced. Further, it makes it easier to fabricate the ground electrode 31 so that the accuracy of the spark gap can be ensured. Furthermore, since at least a part of the inner circumference surface of the cylindrical part 315 forms the spark gap, this can suppress the reduction of the area where the gap forming surface 31A of the ground electrode 31 faces the gap forming surface 25A of the center electrode 20. As a result, this can suppress that the spark discharge between the ground electrode 31 and the center electrode 20 is localized and thereby the ground electrode 31 and/or the center electrode 20 are worn. That is, the wear resistance of the ground electrode 31 and/or the center electrode 20 can be improved.

The insertion member 30 including the ground electrode 31 is formed of the material whose thermal expansion coefficient is higher than that of the metallic shell 50. That is, the metallic shell 50 is formed of the low-carbon steel material. The insertion member 30 is formed of the nickel alloy whose thermal expansion coefficient is higher than that of the low-carbon steel material. As a result, for example, a larger thermal stress is likely to occur in the welding parts WP1 jointing the metallic shell 50 and the insertion member 30 than in the case where the metallic shell 50 and the insertion member 30 have the same thermal expansion coefficient. In the spark plug 100 of the above-described first embodiment, however, the notches NT are formed in the ground electrode 31, so that the thermal stress that would otherwise tend to be large can be effectively reduced.

Further, in the spark plug 100 of the above-described first embodiment, with respect to all the two spokes neighboring in the circumferential direction of the plurality of spokes 32, the angle θ1 between the two spokes (FIG. 4A) is less than or equal to 180 degrees. For example, in the examples of FIG. 3 and FIG. 4A, θ1 is 90 degrees. In this case, a large thermal stress is likely to occur, in particular, at the welding parts WP1 jointing the metallic shell 50 and the insertion member 30. In the spark plug 100 of the above-described first embodiment, however, the notches NT are formed in the ground electrode 31, so that the thermal stress that would otherwise tend to be large can be effectively reduced.

A-3. First Evaluation Test

In a first evaluation test, a sample 1-1 of a spark plug of a comparison form and samples 1-2 to 1-46 for 45 types of the spark plug 100 of the first embodiment are fabricated and an evaluation test was done. The sizes common to each sample are as follows.

The diameter R3 of the virtual circle VC (see FIG. 4A): 13 mm

The axial direction length HT of the ground electrode 31: 6 mm

It is noted that the ground electrode of the sample 1-1 of the spark plug of the comparison form has a cylindrical shape with no notch formed (P=0). On the other hand, the insertion members 30 of the samples 1-2 to 1-46 of the first embodiment have the notches NT.

TABLE 1

| Sample Group | Sample Number | K | S | L | V1 | P | A | B | D | V2 | V1/V2 | Evaluation |
|---|---|---|---|---|---|---|---|---|---|---|---|---|
| — | 1-1 | 3 | 4 | 2.7 | 32.4 | 0 | — | — | 1 | — | — | X |
| G1 | 1-2 | 3 | 4 | 2.7 | 32.4 | 3 | 3 | 1.5 | 1 | 13.5 | 2.4 | ○ |
| | 1-3 | 3 | 4 | 2.7 | 32.4 | 3 | 4 | 1.5 | 1 | 18.0 | 1.8 | ◎ |
| | 1-4 | 3 | 4 | 2.7 | 32.4 | 3 | 5 | 1.5 | 1 | 22.5 | 1.4 | ◎ |
| | 1-5 | 3 | 4 | 2.7 | 32.4 | 3 | 4 | 1.25 | 1 | 15.0 | 2.2 | ○ |
| | 1-6 | 3 | 4 | 2.7 | 32.4 | 3 | 4 | 1.5 | 1 | 18.0 | 1.8 | ◎ |
| | 1-7 | 3 | 4 | 2.7 | 32.4 | 3 | 4 | 1.75 | 1 | 21.0 | 1.5 | ◎ |
| | 1-8 | 3 | 4 | 2.7 | 32.4 | 3 | 4 | 1.5 | 0.75 | 13.5 | 2.4 | ○ |
| | 1-9 | 3 | 4 | 2.7 | 32.4 | 3 | 4 | 1.5 | 1 | 18.0 | 1.8 | ◎ |
| | 1-10 | 3 | 4 | 2.7 | 32.4 | 3 | 4 | 1.5 | 1.25 | 22.5 | 1.4 | ◎ |
| G2 | 1-11 | 4 | 4 | 2.7 | 43.2 | 4 | 3 | 1.5 | 1 | 18.0 | 2.4 | ○ |
| | 1-12 | 4 | 4 | 2.7 | 43.2 | 4 | 4 | 1.5 | 1 | 24.0 | 1.8 | ◎ |
| | 1-13 | 4 | 4 | 2.7 | 43.2 | 4 | 5 | 1.5 | 1 | 30.0 | 1.4 | ◎ |
| | 1-14 | 4 | 4 | 2.7 | 43.2 | 4 | 4 | 1.25 | 1 | 20.0 | 2.2 | ○ |
| | 1-15 | 4 | 4 | 2.7 | 43.2 | 4 | 4 | 1.5 | 1 | 24.0 | 1.8 | ◎ |
| | 1-16 | 4 | 4 | 2.7 | 43.2 | 4 | 4 | 1.75 | 1 | 28.0 | 1.5 | ◎ |
| | 1-17 | 4 | 4 | 2.7 | 43.2 | 4 | 4 | 1.5 | 0.75 | 18.0 | 2.4 | ○ |
| | 1-18 | 4 | 4 | 2.7 | 43.2 | 4 | 4 | 1.5 | 1 | 24.0 | 1.8 | ◎ |
| | 1-19 | 4 | 4 | 2.7 | 43.2 | 4 | 4 | 1.5 | 1.25 | 30.0 | 1.4 | ◎ |
| G3 | 1-20 | 3 | 5 | 2.7 | 40.5 | 3 | 3 | 2 | 1 | 18.0 | 2.3 | ○ |
| | 1-21 | 3 | 5 | 2.7 | 40.5 | 3 | 4 | 2 | 1 | 24.0 | 1.7 | ◎ |
| | 1-22 | 3 | 5 | 2.7 | 40.5 | 3 | 5 | 2 | 1 | 30.0 | 1.4 | ◎ |
| | 1-23 | 3 | 5 | 2.7 | 40.5 | 3 | 4 | 1.75 | 1 | 21.0 | 1.9 | ◎ |
| | 1-24 | 3 | 5 | 2.7 | 40.5 | 3 | 4 | 2 | 1 | 24.0 | 1.7 | ◎ |
| | 1-25 | 3 | 5 | 2.7 | 40.5 | 3 | 4 | 2.25 | 1 | 27.0 | 1.5 | ◎ |
| | 1-26 | 3 | 5 | 2.7 | 40.5 | 3 | 4 | 2 | 0.75 | 18.0 | 2.3 | ○ |
| | 1-27 | 3 | 5 | 2.7 | 40.5 | 3 | 4 | 2 | 1 | 24.0 | 1.7 | ◎ |
| | 1-28 | 3 | 5 | 2.7 | 40.5 | 3 | 4 | 2 | 1.25 | 30.0 | 1.4 | ◎ |
| G4 | 1-29 | 3 | 4 | 3 | 36.0 | 3 | 3 | 1.75 | 1 | 15.8 | 2.3 | ○ |
| | 1-30 | 3 | 4 | 3 | 36.0 | 3 | 4 | 1.75 | 1 | 21.0 | 1.7 | ◎ |
| | 1-31 | 3 | 4 | 3 | 36.0 | 3 | 5 | 1.75 | 1 | 26.3 | 1.4 | ◎ |
| | 1-32 | 3 | 4 | 3 | 36.0 | 3 | 4 | 1.5 | 1 | 18.0 | 2.0 | ◎ |
| | 1-33 | 3 | 4 | 3 | 36.0 | 3 | 4 | 1.75 | 1 | 21.0 | 1.7 | ◎ |
| | 1-34 | 3 | 4 | 3 | 36.0 | 3 | 4 | 2 | 1 | 24.0 | 1.5 | ◎ |
| | 1-35 | 3 | 4 | 3 | 36.0 | 3 | 4 | 1.75 | 0.75 | 15.8 | 2.3 | ○ |
| | 1-36 | 3 | 4 | 3 | 36.0 | 3 | 4 | 1.75 | 1 | 21.0 | 1.7 | ◎ |
| | 1-37 | 3 | 4 | 3 | 36.0 | 3 | 4 | 1.75 | 1.25 | 26.3 | 1.4 | ◎ |
| G5 | 1-38 | 4 | 4 | 2.7 | 43.2 | 2 | 3 | 2.5 | 1 | 15.0 | 2.9 | ○ |
| | 1-39 | 4 | 4 | 2.7 | 43.2 | 2 | 4 | 2.5 | 1 | 20.0 | 2.2 | ○ |

TABLE 1-continued

| Sample Group | Sample Number | K | S | L | V1 | P | A | B | D | V2 | V1/V2 | Evaluation |
|---|---|---|---|---|---|---|---|---|---|---|---|---|
| | 1-40 | 4 | 4 | 2.7 | 43.2 | 2 | 5 | 2.5 | 1 | 25.0 | 1.7 | ◎ |
| | 1-41 | 4 | 4 | 2.7 | 43.2 | 2 | 4 | 2.25 | 1 | 18.0 | 2.4 | ○ |
| | 1-42 | 4 | 4 | 2.7 | 43.2 | 2 | 4 | 2.5 | 1 | 20.0 | 2.2 | ○ |
| | 1-43 | 4 | 4 | 2.7 | 43.2 | 2 | 4 | 2.75 | 1 | 22.0 | 2.0 | ◎ |
| | 1-44 | 4 | 4 | 2.7 | 43.2 | 2 | 4 | 2.5 | 0.75 | 15.0 | 2.9 | ○ |
| | 1-45 | 4 | 4 | 2.7 | 43.2 | 2 | 4 | 2.5 | 1 | 20.0 | 2.2 | ○ |
| | 1-46 | 4 | 4 | 2.7 | 43.2 | 2 | 4 | 2.5 | 1.25 | 25.0 | 1.7 | ◎ |

As indicated in Table 1, the samples 1-2 to 1-46 for the 45 types of the spark plug 100 of the first embodiment in the present evaluation test will be described by classifying them into five sample groups G1 to G5. Among four sample groups G1 to G4, the configuration of the spokes 32 is different from each other. Specifically, among the four sample groups G1 to G4, at least one of the number K of the spokes 32, the sectional area S (the unit is square mm) of one spoke 32, and the radial direction length L (the unit is mm) of one spoke 32 is different. The configuration of the spokes 32 of the sample group G5 is the same as that of the sample group G2.

Specifically, the number K of the spokes 32 is "3" in the sample groups G1, G3, and G4, and the number K of the spokes 32 is "4" in the sample groups G2 and G5. Further, the sectional area S of one spoke 32 is 4 square mm in the sample groups G1, G2, G4, and G5, and the sectional area S of one spoke 32 is 5 square mm in the sample group G3. The sectional area S was changed by changing the circumferential direction length W of the spoke 32 (S=H×W). The radial direction length L of one spoke 32 is 2.7 mm in the sample groups G1 to G3 and G5, and the radial direction length L of one spoke 32 is 3 mm in the sample group G4. The radial direction length L was changed by changing the outer diameter R2 of the ground electrode 31 of the spoke 32 (L=(R3−R2)/2).

It is noted that V1 indicated in Table 1 is calculated by the equation of V1=(K×S×L). V1 represents the total value of the volumes of the K spokes 32 (the unit is cubic mm).

Furthermore, the number P of the notches NT formed in the ground electrode 31 is three in the sample groups G1, G3, and G4. That is, in the ground electrode 31 of each sample of the sample groups G1, G3, and G4, one notch NT is formed at each position in the circumferential direction between two spokes neighboring in the circumferential direction of three spokes 32 and thus three notches NT in total are formed.

In the sample group G2, the number P of the notches NT formed in the ground electrode 31 is four. That is, in the ground electrode 31 of each sample of the sample group G2, one notch NT is formed at each position in the circumferential direction between two spokes neighboring in the circumferential direction of four spokes 32 and thus four notches NT in total are formed (the same as the examples of FIG. 3, FIG. 4A and FIG. 4B).

In the sample group G5, the number P of the notches NT formed in the ground electrode 31 is two. That is, in the ground electrode 31 of each sample of the sample group G5, the notch NT is formed at each of two positions of the positions in the circumferential direction between two spokes neighboring in the circumferential direction of four spokes 32 and no notch NT is formed at the remaining two positions. It is noted that the two notches NT are formed at the positions opposing in the radial direction interposing the axial line CO.

As indicated in Table 1, among nine samples included in each of the sample groups G1 to G4, they are different from each other in the size of one notch NT. For example, the axial direction length A of the notch NT of each sample is any one value of 3 mm, 4 mm, and 5 mm. The circumferential direction length B of the notch NT of each sample is any one value of 1.25 mm, 1.5 mm, 1.75 mm, 2 mm, 2.25 mm, 2.5 mm, and 2.75 mm. Further, the radial direction thickness D of the ground electrode 31 representing the length in the radial direction of the notch NT is any one value of 0.75 mm, 1 mm, and 1.25 mm.

It is noted that V2 indicated in Table 1 is calculated by the equation of V2=(P×A×B×D). V2 represents the total value of the capacities of the P notches NT (the unit is cubic mm).

Furthermore, the value of (V1/V2) is indicated in Table 1. That is to say, (V1/V2) represents the ratio of the total value V1 of the volumes of the spokes to the total value V2 of the capacities of the notches NT.

In the first evaluation test, a cycle of a heating and a cooling of the vicinity of the front end part (the vicinity of the front end part of the metallic shell 50) of each sample of the spark plug 100 was repeated for 1000 times. Specifically, one cycle is to heat the vicinity of the front end part of each sample by a burner for two minutes and, subsequently, cool it in the air for one minute (also referred to as thermal cyclic test). The firepower of the burner was adjusted so that the temperature of the front end part of the metallic shell 50 reaches a predetermined target temperature by the two-minute heating. Then, by a visual check from the front end direction D1 side toward the rear end direction D2, it was checked whether or not there was a crack in the welding parts WP1 jointing the insertion member 30 and the metallic shell 50.

It is noted that two subjects were prepared for each sample, and a thermal cyclic test in which the target temperature is 1000 degrees centigrade and a thermal cyclic test in which the target temperature is 1100 degrees centigrade were done for each sample.

The samples in which the crack occurred in the test of the target temperature of 1000 degrees centigrade were evaluated as "X-mark (poor)". Further, the samples in which the crack did not occur in the thermal cyclic test of the target temperature of 1000 degrees centigrade and the crack occurred in the thermal cyclic test of the target temperature of 1100 degrees centigrade were evaluated as "circle mark (fair/good)". The samples in which the crack did not occur in the thermal cyclic test of the target temperature of 1000 degrees centigrade and the crack did not occur in the thermal cyclic test of the target temperature of 1100 degrees centigrade were evaluated as "double-circle mark (excellent)" (Table 1).

As indicated in Table 1, the evaluation result of the sample of the spark plug of the comparison form, that is, the sample 1-1 with no notch formed in the ground electrode was "X-mark". The evaluation of the 45 samples of the first embodiment, that is, the samples 1-2 to 1-46 with the notches NT formed in the ground electrode 31 was either "circle mark" or "double-circle mark".

From this result, it has been proven that the damage on the spark plug 100, specifically, the damage on the welding part WP1 can be suppressed by forming the notch NT in the ground electrode 31.

In more detail, among the 45 samples 1-2 to 1-46 of the spark plug 100 of the first embodiment, the evaluations of 16 samples 1-2, 1-5, 1-8, 1-11, 1-14, 1-17, 1-20, 1-26, 1-29, 1-35, 1-38, 1-39, 1-41, 1-42, 1-44, and 1-45 in which (V1/V2) exceeds two were "circle mark". Among the 45 samples 1-2 to 1-46 of the spark plug 100 of the first embodiment, the evaluations of 29 samples except the above 16 samples were "double-circle". That is, among the 45 samples 1-2 to 1-46, the evaluations of all the samples in which (V1/V2) is less than or equal to two were "double-circle mark".

The reason for it is considered as follows. It is considered that the force applied to the welding part WP1 by each spoke 32 is the value (the unit is N, for example) resulted by multiplying the thermal stress (the unit is N/square mm, for example) by the sectional area of each spoke 32 (the unit is the square mm, for example). Further, a larger radial direction length L of each spoke 32 results in a larger expansion amount of the radial direction length L of each spoke 32 due to the thermal expansion, so that the force applied to the welding part WP1 by each spoke 32 becomes larger. It is therefore considered that a larger product of the sectional area S and the radial direction length L of each spoke 32 (S×L), that is, a larger volume of each spoke 32 results in a larger force applied to the welding part WP1 by each spoke 32. Therefore, it is considered that a larger value of V1, that is, a larger total value of the volumes of the K spokes 32 results in a larger force applied to the welding parts WP1 by the K spokes 32.

On the other hand, a larger value of V2, that is, a larger total value of the capacities of the notches NT results in the reduction of the rigidity of the ground electrode 31. As a result, a larger value of V2 facilitates the bending of the front end part 311 of the ground electrode 31 and thus allows for a larger degree of the reduction of the thermal stress. It is thus considered that the thermal stress can be more effectively reduced when the total value V1 of the volumes of the spokes 32 is relatively small with respect to the total value V2 of the capacities of the notches NT, that is, when (V1/V2) is less than or equal to two.

In other words, it has been proven that, when the size of the K spokes 32 (that is, the values of S and L) is equal to each other and the size of the P notches NT (that is, the values of A, B, and D) is equal to each other, it is more preferable that the following equation (3) is satisfied.

$$(K \times S \times L)/(P \times A \times B \times D) \leq 2 \quad (3)$$

This allows the thermal stress to be more effectively reduced, so that the damage on the spark plug 100 can be more effectively suppressed. It is noted that, as described above, even when the number K of the spokes and/or the number P of the notches NT were changed, the samples satisfying the above equation (3) were evaluated as "double-circle mark", while the samples not satisfying the above equation (3) were evaluated as "circle mark". From this fact, it is considered that the damage on the spark plug 100 can be more effectively suppressed when the above equation (3) is satisfied regardless of the number K of the spokes and the number P of the notches NT.

B. Second Embodiment

B-1. Configuration

Figure 5:
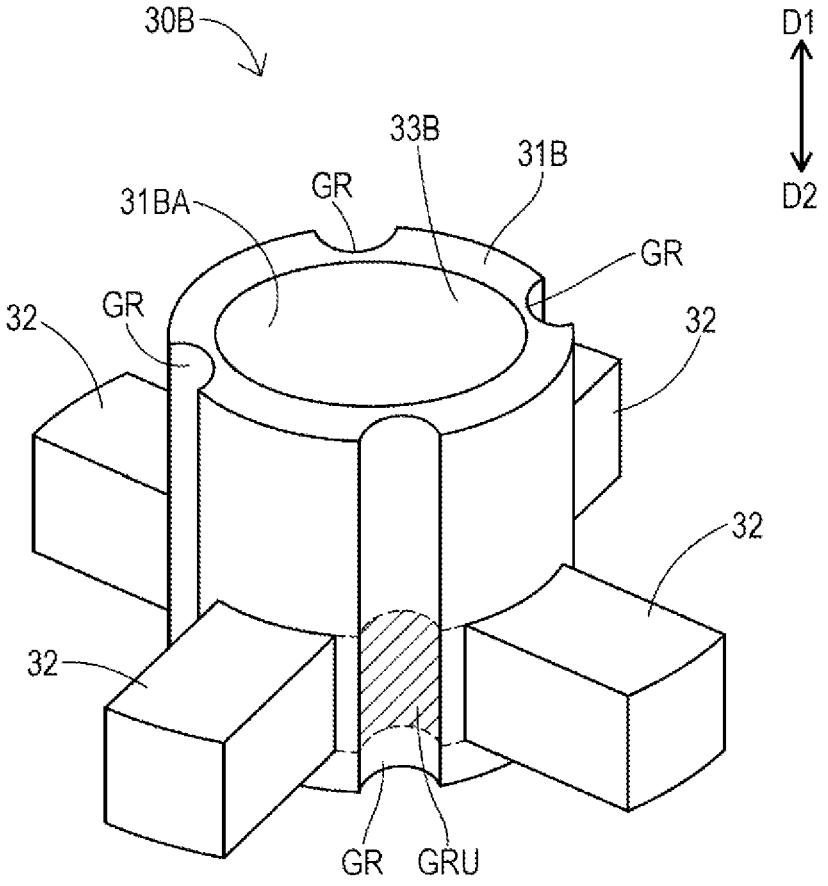
FIG. 5 is a perspective view of the insertion member 30B of a second embodiment.
Figure 6A:
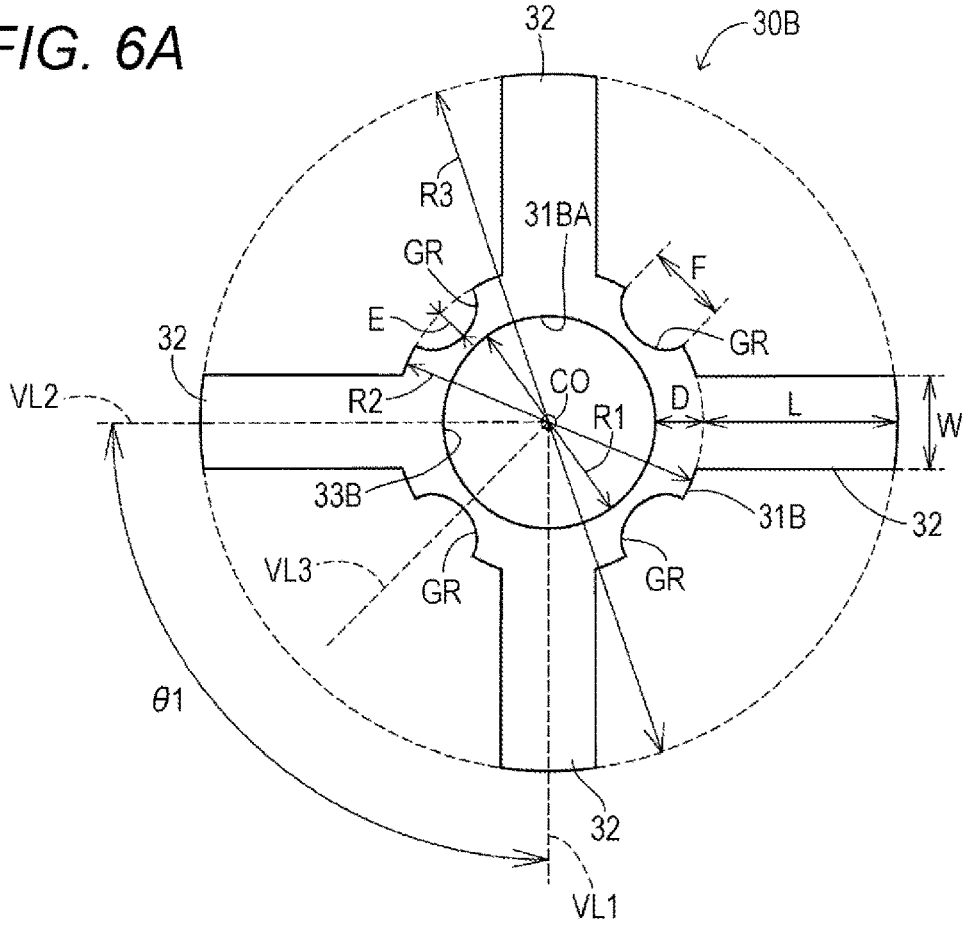
FIG. 6A is an external view and FIG. 6B is a cross-sectional view of the insertion member 30B of the second embodiment.
Figure 6B:
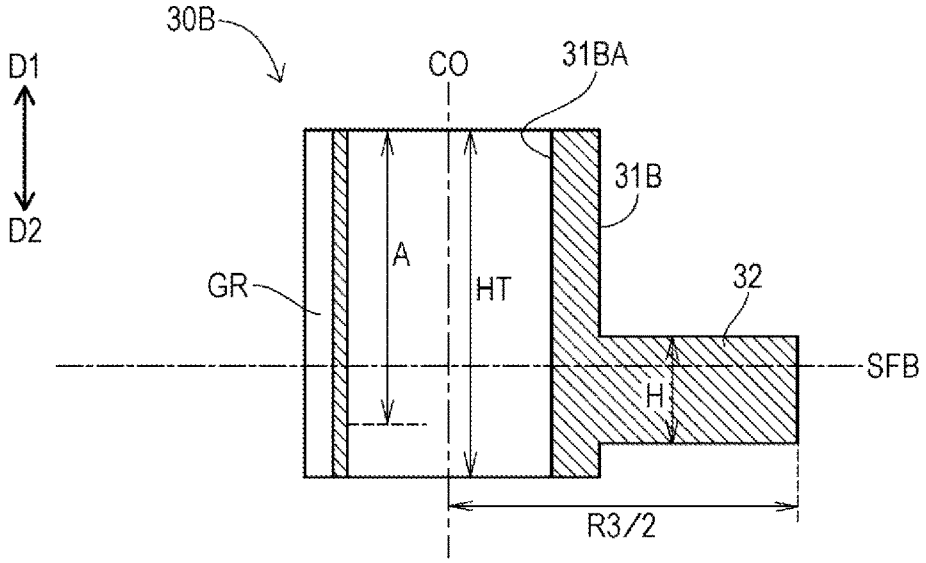

The spark plug of a second embodiment has an insertion member 30B in place of the insertion member 30 of the first embodiment (FIG. 3, FIG. 4A and FIG. 4B). FIG. 5 is a perspective view of the insertion member 30B. FIG. 6A is a view of the insertion member 30B viewed from the rear end side to the front end direction D1. FIG. 6B is a cross-sectional view of the insertion member 30B cut by a plane C2-C2 including the axial line CO (FIG. 5A). The components other than the insertion member 30B of the spark plug of the second embodiment are the same as those of the spark plug 100 of the first embodiment (FIG. 1 and FIG. 2). Accordingly, the entire configuration view of the spark plug of the second embodiment is omitted and the references in FIG. 1 and FIG. 2 will be used for the components other than the insertion member 30B.

The insertion member 30B of FIG. 5 has a ground electrode 31B that is different from the ground electrode 31 of the first embodiment (FIG. 3, FIG. 4A and FIG. 4B) and the same spokes 32 as the spokes 32 of the first embodiment. Thus, with respect to the configuration and the size of the spokes 32, description will be omitted and the same references as in FIG. 3, FIG. 4A and FIG. 4B will be used.

The ground electrode 31B is different from the ground electrode 31 of the first embodiment (FIG. 3, FIG. 4A and FIG. 4B) in that it has P grooves GR in place of the P notches NT. The configurations other than the ground electrode 31B are the same as those of the ground electrode 31 of the first embodiment. Thus, the inner diameter, the outer diameter, the radial direction thickness, and the axial direction length of the ground electrode 31B are expressed by using the same references "R1", "R2", "D", and "HT" as the inner diameter, the outer diameter, the radial direction thickness, and the axial direction length of the ground electrode 31 of the first embodiment, respectively.

The ground electrode 31B has substantially a cylindrical shape. Unlike the ground electrode 31 of the first embodiment, since no notch NT is formed, the ground electrode 31B is continuous over the entire circumference in the circumferential direction in the entire length in the axial direction.

The positions in the circumferential direction where the grooves GR are formed are different from the positions in the circumferential direction where the ground electrode 31B is connected to each spoke 32, similarly to the notches NT of the first embodiment. In the examples of FIG. 5, FIG. 6A and FIG. 6B, each groove GR is formed in the center position in the circumferential direction of two spokes 32 neighboring to each other. Further, the groove GR extends along the axial direction from the front end to the rear end of the ground electrode 31B. In other words, the groove GR is formed over the entire length in the axial direction of the ground electrode 31B.

In the groove GR the cross section orthogonal to the axial direction has an arc shape. The maximum value of the length in the radial direction of the groove GR is denoted as a radial direction depth E of the groove GR. Further, the circumferential direction length of the groove GR is denoted as F.

As illustrated in FIG. 6B, the range in the radial direction where the groove GR is formed (the range of the length HT of FIG. 6B) overlaps the range in the axial direction where the spoke 32 is formed (the range of the length H of FIG. 6B). That is, the groove GR and the spoke 32 are arranged on a particular plane orthogonal to the axial line CO (for example, a plane SFB of FIG. 6B), respectively.

In the spark plug of the second embodiment as described above, the grooves GR are formed in the ground electrode 31B, which facilitates the bending of the ground electrode 31B. As a result, similarly to the spark plug 100 of the first embodiment, even when, for example, the radial direction length L of the spoke 32 changes due to the thermal expansion, the ground electrode 31B slightly bends, so that the thermal stress caused by the thermal expansion can be effectively reduced. Therefore, the damage on the spark plug 100, for example, the occurrence of the crack in the welding parts WP1 due to the thermal stress can be suppressed. As a result, the durability property of the spark plug can be improved.

Further, as described above, in the spark plug of the above-described second embodiment, the grooves GR and the spokes 32 are arranged on the particular plane orthogonal to the axial direction (for example, the plane SFB (FIG. 6B)), respectively. As a result, the thermal stress due to the thermal expansion of the spokes 32 and/or the ground electrode 31B can be effectively reduced by the grooves GR arranged on the same plane as the spokes 32.

Moreover, in the spark plug 100 of the above-described third embodiment, the grooves GR extend along the axial direction from the front end to the rear end of the ground electrode 31B. As a result, the ground electrode 31B is more likely to bend. As a result, the thermal stress caused by the thermal expansion can be more effectively reduced.

Moreover, because the grooves GR are provided in place of the notches NT, the ground electrode 31B is continuous over the entire circumference in the circumferential direction in the entire length in the axial direction. As a result, this allows for the suppression of the excessive reduction of the rigidity of the ground electrode 31B. As a result, this allows for the suppression of the change in the spark gap while reducing the thermal stress, for example. Further, it facilitates easier fabrication of the ground electrode 31 so as to be able to ensure the accuracy of the spark gap. Further, a gap forming surface 31BA of the ground electrode 31B is wider than the gap forming surface 31A of the ground electrode 31 of the first embodiment. As a result, this can suppress that the spark discharge between the ground electrode 31 and the center electrode 20 is localized and thereby the ground electrode 31 and/or the center electrode 20 are worn. That is, the wear resistance of the ground electrode 31B and/or the center electrode 20 can be improved.

It is noted that, similarly to the insertion member 30 of the first embodiment, the insertion member 30B including the ground electrode 31B is formed of the material (specifically, the nickel alloy) whose thermal expansion coefficient is higher than that of the metallic shell 50 (specifically, the low-carbon steel material). Therefore, in the spark plug of the above-described second embodiment, by the grooves GR being formed in the ground electrode 31B, the thermal stress that would otherwise tend to be large can be effectively reduced.

Further, in the spark plug of the above-described second embodiment, with respect to all the two spokes neighboring in the circumferential direction of the plurality of spokes 32, the angle θ1 between the two spokes (FIG. 6A) is less than or equal to 180 degrees, similarly to the spark plug 100 of the first embodiment. In the example of FIG. 4A, θ1 is 90 degrees. In this case, in particular, a large thermal stress is likely to occur at the welding part WP1 jointing the metallic shell 50 and the insertion member 30. Therefore, in the spark plug of the above-described second embodiment, the grooves GR are formed in the ground electrode 31B, so that the thermal stress that would otherwise tend to be large can be effectively reduced.

B-2. Second Evaluation Test

In a second evaluation test, a sample 2-1 of a spark plug of a comparison form and samples 2-2 to 1-51 for 50 types of spark plug of the second embodiment are fabricated and an evaluation test was done. The sizes common to each sample are as follows.

The diameter R3 of the virtual circle VC (see FIG. 6A): 13 mm

The axial direction length HT of the ground electrode 31: 6 mm

It is noted that the ground electrode of the sample 2-1 of the spark plug of the comparison form has a cylindrical shape with no groove formed (P=0). On the other hand, the insertion members 30B of the samples 2-2 to 2-51 of the first embodiment have the grooves GR.

TABLE 2

| Sample Group | Sample Number | K | S | L | V1 | P | H | D | E | F | V3 | V1/V3 | Evaluation |
|---|---|---|---|---|---|---|---|---|---|---|---|---|---|
| — | 2-1 | 3 | 4 | 2.7 | 32.4 | 0 | 2 | 1 | — | — | — | — | X |
| G6 | 2-2 | 3 | 4 | 2.7 | 32.4 | 3 | 1.75 | 1 | 0.7 | 1.4 | 3.6 | 9.0 | ○ |
| | 2-3 | 3 | 4 | 2.7 | 32.4 | 3 | 2 | 1 | 0.7 | 1.4 | 4.1 | 7.9 | ◎ |
| | 2-4 | 3 | 4 | 2.7 | 32.4 | 3 | 2.25 | 1 | 0.7 | 1.4 | 4.6 | 7.0 | ◎ |
| | 2-5 | 3 | 4 | 2.7 | 32.4 | 3 | 2 | 1 | 0.7 | 1.4 | 4.1 | 7.9 | ◎ |
| | 2-6 | 3 | 4 | 2.7 | 32.4 | 3 | 2 | 1.25 | 0.7 | 1.4 | 3.3 | 9.8 | ○ |
| | 2-7 | 3 | 4 | 2.7 | 32.4 | 3 | 2 | 1 | 0.5 | 1.4 | 2.1 | 15.4 | ○ |
| | 2-8 | 3 | 4 | 2.7 | 32.4 | 3 | 2 | 1 | 0.7 | 1.4 | 4.1 | 7.9 | ◎ |
| | 2-9 | 3 | 4 | 2.7 | 32.4 | 3 | 2 | 1 | 0.7 | 1.2 | 3.5 | 9.2 | ○ |
| | 2-10 | 3 | 4 | 2.7 | 32.4 | 3 | 2 | 1 | 0.7 | 1.4 | 4.1 | 7.9 | ◎ |
| | 2-11 | 3 | 4 | 2.7 | 32.4 | 3 | 2 | 1 | 0.7 | 1.6 | 4.7 | 6.9 | ◎ |
| G7 | 2-12 | 4 | 4 | 2.7 | 43.2 | 4 | 1.75 | 1 | 0.7 | 1.4 | 4.8 | 9.0 | ○ |
| | 2-13 | 4 | 4 | 2.7 | 43.2 | 4 | 2 | 1 | 0.7 | 1.4 | 5.5 | 7.9 | ◎ |
| | 2-14 | 4 | 4 | 2.7 | 43.2 | 4 | 2.25 | 1 | 0.7 | 1.4 | 6.2 | 7.0 | ◎ |
| | 2-15 | 4 | 4 | 2.7 | 43.2 | 4 | 2 | 1 | 0.7 | 1.4 | 5.5 | 7.9 | ◎ |
| | 2-16 | 4 | 4 | 2.7 | 43.2 | 4 | 2 | 1.25 | 0.7 | 1.4 | 4.4 | 9.8 | ○ |
| | 2-17 | 4 | 4 | 2.7 | 43.2 | 4 | 2 | 1 | 0.5 | 1.4 | 2.8 | 15.4 | ○ |
| | 2-18 | 4 | 4 | 2.7 | 43.2 | 4 | 2 | 1 | 0.7 | 1.4 | 5.5 | 7.9 | ◎ |
| | 2-19 | 4 | 4 | 2.7 | 43.2 | 4 | 2 | 1 | 0.7 | 1.2 | 4.7 | 9.2 | ○ |
| | 2-20 | 4 | 4 | 2.7 | 43.2 | 4 | 2 | 1 | 0.7 | 1.4 | 5.5 | 7.9 | ◎ |
| | 2-21 | 4 | 4 | 2.7 | 43.2 | 4 | 2 | 1 | 0.7 | 1.6 | 6.3 | 6.9 | ◎ |

TABLE 2-continued

| Sample Group | Sample Number | K | S | L | V1 | P | H | D | E | F | V3 | V1/V3 | Evaluation |
|---|---|---|---|---|---|---|---|---|---|---|---|---|---|
| G8 | 2-22 | 3 | 5 | 2.7 | 40.5 | 3 | 1.75 | 1 | 0.7 | 1.4 | 3.6 | 11.2 | ○ |
| | 2-23 | 3 | 5 | 2.7 | 40.5 | 3 | 2 | 1 | 0.7 | 1.4 | 4.1 | 9.8 | ○ |
| | 2-24 | 3 | 5 | 2.7 | 40.5 | 3 | 2.25 | 1 | 0.7 | 1.4 | 4.6 | 8.7 | ○ |
| | 2-25 | 3 | 5 | 2.7 | 40.5 | 3 | 2 | 1 | 0.7 | 1.4 | 4.1 | 9.8 | ○ |
| | 2-26 | 3 | 5 | 2.7 | 40.5 | 3 | 2 | 1.25 | 0.7 | 1.4 | 3.3 | 12.3 | ○ |
| | 2-27 | 3 | 5 | 2.7 | 40.5 | 3 | 2 | 1 | 0.5 | 1.4 | 2.1 | 19.3 | ○ |
| | 2-28 | 3 | 5 | 2.7 | 40.5 | 3 | 2 | 1 | 0.7 | 1.4 | 4.1 | 9.8 | ○ |
| | 2-29 | 3 | 5 | 2.7 | 40.5 | 3 | 2 | 1 | 0.7 | 1.2 | 3.5 | 11.5 | ○ |
| | 2-30 | 3 | 5 | 2.7 | 40.5 | 3 | 2 | 1 | 0.7 | 1.4 | 4.1 | 9.8 | ○ |
| | 2-31 | 3 | 5 | 2.7 | 40.5 | 3 | 2 | 1 | 0.7 | 1.6 | 4.7 | 8.6 | ○ |
| G9 | 2-32 | 3 | 4 | 3 | 36.0 | 3 | 1.75 | 1 | 0.7 | 1.4 | 3.6 | 10.0 | ○ |
| | 2-33 | 3 | 4 | 3 | 36.0 | 3 | 2 | 1 | 0.7 | 1.4 | 4.1 | 8.7 | ○ |
| | 2-34 | 3 | 4 | 3 | 36.0 | 3 | 2.25 | 1 | 0.7 | 1.4 | 4.6 | 7.8 | ◎ |
| | 2-35 | 3 | 4 | 3 | 36.0 | 3 | 2 | 1 | 0.7 | 1.4 | 4.1 | 8.7 | ○ |
| | 2-36 | 3 | 4 | 3 | 36.0 | 3 | 2 | 1.25 | 0.7 | 1.4 | 3.3 | 10.9 | ○ |
| | 2-37 | 3 | 4 | 3 | 36.0 | 3 | 2 | 1 | 0.5 | 1.4 | 2.1 | 17.1 | ○ |
| | 2-38 | 3 | 4 | 3 | 36.0 | 3 | 2 | 1 | 0.7 | 1.4 | 4.1 | 8.7 | ○ |
| | 2-39 | 3 | 4 | 3 | 36.0 | 3 | 2 | 1 | 0.7 | 1.2 | 3.5 | 10.2 | ○ |
| | 2-40 | 3 | 4 | 3 | 36.0 | 3 | 2 | 1 | 0.7 | 1.4 | 4.1 | 8.7 | ○ |
| | 2-41 | 3 | 4 | 3 | 36.0 | 3 | 2 | 1 | 0.7 | 1.6 | 4.7 | 7.7 | ◎ |
| G10 | 2-42 | 4 | 4 | 2.7 | 43.2 | 2 | 1.75 | 1 | 0.8 | 2 | 4.5 | 9.6 | ○ |
| | 2-43 | 4 | 4 | 2.7 | 43.2 | 2 | 2 | 1 | 0.8 | 2 | 5.1 | 8.4 | ○ |
| | 2-44 | 4 | 4 | 2.7 | 43.2 | 2 | 2.25 | 1 | 0.8 | 2 | 5.8 | 7.5 | ◎ |
| | 2-45 | 4 | 4 | 2.7 | 43.2 | 2 | 2 | 1 | 0.8 | 2 | 5.1 | 8.4 | ○ |
| | 2-46 | 4 | 4 | 2.7 | 43.2 | 2 | 2 | 1.25 | 0.8 | 2 | 4.1 | 10.5 | ○ |
| | 2-47 | 4 | 4 | 2.7 | 43.2 | 2 | 2 | 1 | 0.6 | 2 | 2.9 | 15.0 | ○ |
| | 2-48 | 4 | 4 | 2.7 | 43.2 | 2 | 2 | 1 | 0.8 | 2 | 5.1 | 8.4 | ○ |
| | 2-49 | 4 | 4 | 2.7 | 43.2 | 2 | 2 | 1 | 0.8 | 1.8 | 4.6 | 9.4 | ○ |
| | 2-50 | 4 | 4 | 2.7 | 43.2 | 2 | 2 | 1 | 0.8 | 2 | 5.1 | 8.4 | ○ |
| | 2-51 | 4 | 4 | 2.7 | 43.2 | 2 | 2 | 1 | 0.8 | 2.2 | 5.6 | 7.7 | ◎ |

As indicated in Table 2, the samples 2-2 to 2-51 for the 50 types of the spark plug of the second embodiment in the present evaluation test will be described by classifying them into five sample groups G6 to G10. Among four sample groups G6 to G9, they are different from each other in the configuration of the spokes 32. Specifically, the number K of the spokes 32, the sectional area S (the unit is square mm) of one spoke 32, and the radial direction length L (the unit is mm) of one spoke 32 in the sample groups G6 to G9 are the same as those in the four sample groups G1 to G4 (Table 1) of the first embodiment, respectively. The configuration of the spokes 32 of the sample group G10 is the same as that of the sample group G7.

It is noted that V1 indicated in Table 2 is calculated by the equation of V1=(K×S×L), similarly to V1 in Table 1.

Furthermore, the number P of the grooves GR formed in the ground electrode 31B is three in the sample groups G6, G8, and G9. That is, in the ground electrode 31B of each sample of the sample groups G6, G8, and G9, one groove GR is formed at each position in the circumferential direction between two spokes neighboring in the circumferential direction of three spokes 32 and thus three grooves GR in total are formed.

In the sample group G7, the number P of the grooves GR formed in the ground electrode 31B is four. That is, in the ground electrode 31B of each sample of the sample group G7, one groove GR is formed at each position in the circumferential direction between two spokes neighboring in the circumferential direction of four spokes 32 and thus four grooves GR in total are formed (the same as the examples of FIG. 5, FIG. 6A and FIG. 6B).

In the sample group G10, the number P of the grooves GR formed in the ground electrode 31B is two. That is, in the ground electrode 31B of each sample of the sample group G10, the groove GR is formed at each of two positions of the positions in the circumferential direction between two spokes neighboring in the circumferential direction of four spokes 32 and no groove GR is formed at the remaining two positions. It is noted that the two grooves GR are formed at the positions opposing in the radial direction interposing the axial line CO.

It is noted that Table 2 indicates the axial direction length H of the spoke 32 (the unit is mm). In the spoke 32 of each sample, the circumferential direction length W of the spoke 32 is adjusted depending on the axial direction length H indicated in Table 2 so as to have the sectional area S indicated in Table 2.

As indicated in Table 2, among a plurality of samples included in each of the sample groups G6 to G10, they are different from each other in the size of one groove GR. For example, the circumferential direction length F of the groove GR in each sample is any one value of 1.2 mm, 1.4 mm, 1.6 mm, 1.8 mm, 2 mm, and 2.2 mm. The radial direction depth E of the groove GR in each sample is any one value of 0.5 mm, 0.6 mm, 0.7 mm, and 0.8 mm. The radial direction thickness D of the ground electrode 31B is one of the values of 1 mm and 1.25 mm.

It is noted that V3 indicated in Table 2 is calculated by the equation of V3={P×(H×E×F)×(E/D)}. (H×E×F) represents the approximate value of the capacity of the portion GRU (the hatched portion of FIG. 5) corresponding to the axial direction length H of the spoke 32 for one groove GR. (E/D) represents the depth E of the groove GR with respect to the radial direction thickness D of the ground electrode 31B.

Furthermore, the value of (V1/V3) is indicated in Table 2.

In the second evaluation test, similarly to the first evaluation test, two subjects were prepared for each sample, and a thermal cyclic test in which the target temperature is 1000 degrees centigrade and a thermal cyclic test in which the target temperature is 1100 degrees centigrade were done for each sample.

In the second evaluation test, similarly to the first evaluation test, the samples in which the crack occurred in the thermal cyclic test of the target temperature of 1000 degrees centigrade were evaluated as "X-mark (poor)". Further, the samples in which the crack did not occur in the thermal cyclic test of the target temperature of 1000 degrees centigrade and the crack occurred in the thermal cyclic test of the target temperature of 1100 degrees centigrade were evaluated as "circle mark (fair/good)". The samples in which the crack did not occur in the thermal cyclic test of the target temperature of 1000 degrees centigrade and the crack did not occur in the thermal cyclic test of the target temperature of 1100 degrees centigrade were evaluated as "double-circle mark (excellent)" (Table 2).

As indicated in Table 2, the evaluation result of the sample of the spark plug of the comparison form, that is, the sample 2-1 with no groove formed in the ground electrode was "X-mark". The evaluations of the 50 samples of the second embodiment, that is, the samples 2-2 to 2-51 with the grooves GR formed in the ground electrode 31B were either "circle mark" or "double-circle mark".

From this result, it has been proven that the damage on the spark plug, specifically, the damage on the welding parts WP1 can be suppressed by forming the grooves GR in the ground electrode 31B.

In more detail, among the 50 samples 2-2 to 2-51 of the spark plug of the second embodiment, the evaluations of 34 samples 2-2, 2-6, 2-7, 2-9, 2-12, 2-16, 2-17, 2-19, 2-22 to 2-33, 2-35 to 2-40, 2-42, 2-43, and 2-45 to 2-50 in which (V1/V3) exceeds eight were "circle mark". Among the 50 samples 2-2 to 2-51 of the spark plug of the second embodiment, the evaluations of 16 samples except the above 34 samples were "double-circle mark". That is, among the 50 samples 2-2 to 2-51, the evaluations of all the samples in which (V1/V3) is less than or equal to eight were "double-circle mark".

The reason for it is considered as follows. Similarly to the first evaluation test, it is considered that a larger value of V1, that is, a larger total value of the volume of the K spokes 32 results in a larger force applied to the welding parts WP1 by the change in the radial direction length L of the spokes 32 due to the thermal expansion.

On the other hand, a larger value of P×(H×E×F), that is, a larger total value of the approximate capacities of the portion GRU corresponding to the axial direction length H of the spokes 32 with the K grooves GR facilitates the bending of the ground electrode 31B. Further, a larger value of (E/D), that is, a larger ratio of the depth E of the groove GR to the radial direction thickness D of the ground electrode 31B facilitates the bending of the ground electrode 31B. It is thus considered that the value of V3={P×(H×E×F)×(E/D)}, which is obtained by multiplying the above two values, can be used as an index value representing how much the ground electrode 31B is likely to bend. That is, it is considered that a larger value of V3 facilitates the bending of the ground electrode 31B and thus allows for a larger degree of the reduction of the thermal stress.

Thus, it is considered that the thermal stress can be more effectively reduced when the total value V1 of the volumes of the spokes 32 is relatively small with respect to the index value V3, that is, when (V1/V3) is less than or equal to eight.

In other words, it has been proven that, when the size of the K spokes 32 (that is, the values of S, L, and H) is equal to each other and the size of the P grooves GR (that is, the values of E and F) is equal to each other, it is more preferable that the following equation (4) is satisfied.

$$(K\times S\times L)/\{P\times(H\times E\times F)\times(E/D)\}\leq 8 \quad (4)$$

This allows the thermal stress to be more effectively reduced, so that the damage on the spark plug can be more effectively suppressed. It is noted that, as described above, even when the number K of the spokes and/or the number P of the grooves GR were changed, the samples satisfying the above equation (4) were evaluated as "double-circle mark", while the samples not satisfying the above equation (4) were evaluated as "circle mark". From this fact, it is considered that the damage on the spark plug can be more effectively suppressed when the above equation (4) is satisfied regardless of the number K of the spokes and/or the number P of the grooves GR.

D. Modified Examples (1) In the insertion members 30 and 30B of each of the above-described embodiments, the axial direction length HT of the ground electrodes 31 and 31B is longer than the axial direction length H of the spoke 32. Alternatively, the connection part and the ground electrode may have the same length in the axial direction.

Figure 7A:
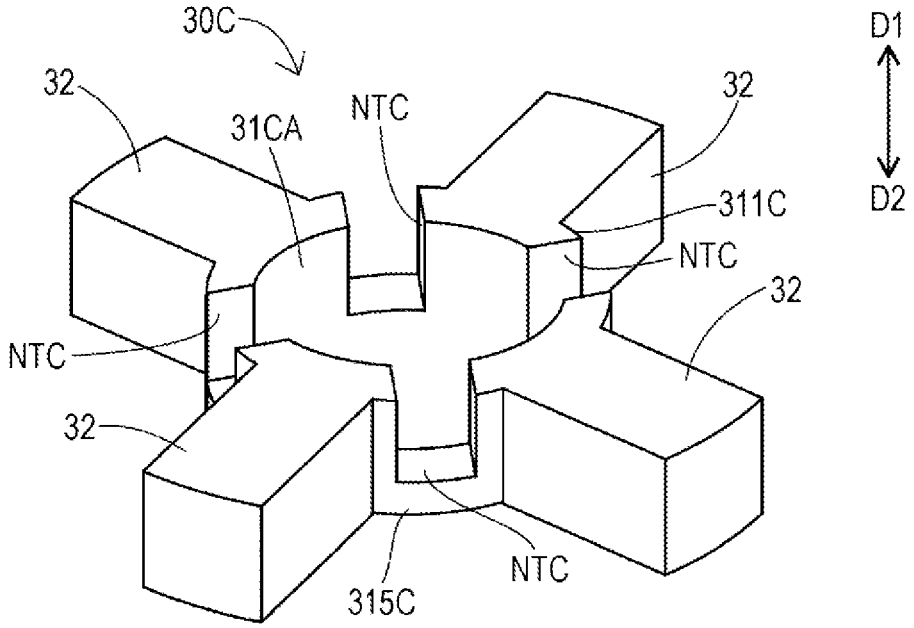
FIG. 7A is a perspective view and FIG. 7B is a cross-sectional view of an example of an insertion member 30C of a modified example.
Figure 7B:
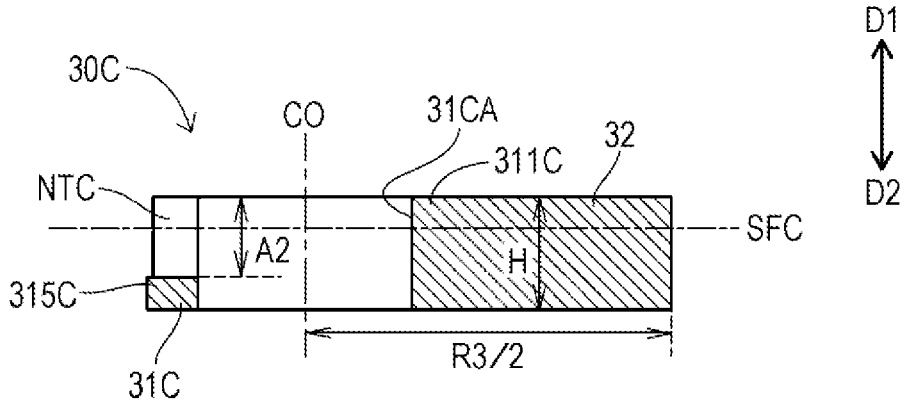

FIG. 7A illustrates a perspective view and FIG. 7B illustrates a sectional view of an example of an insertion member 30C of the present modified example. The insertion member 30C has the same spokes 32 as the spokes 32 of the first embodiment (FIGS. 3 and 4A and 4B) whose length in the axial direction is H and a ground electrode 31C whose length in the axial direction is H that is the same as the spokes 32.

In the ground electrode 31C, notches NTC are formed similarly to the ground electrode 31 of the first embodiment. That is, the ground electrode 31 has, in the rear end side, a cylindrical part 315C continuous over the entire circumference in the circumferential direction and, in the front end side, a front end part 311C in which the notches NTC are formed.

In the ground electrode 31C, unlike the first embodiment, an axial direction length A2 of the notch NTC is shorter than the axial direction length H of the spoke 32 and longer than half the axial direction length H of the spoke 32 ((H/2) ≤A2<H). In this way, it is preferable that the axial direction length of the notch is greater than the half the axial direction length of the spoke. This allows for the effective reduction of the thermal stress due to the thermal expansion of the spokes and/or the ground electrode by means of the relatively large notches.

(2) In the above-described first embodiment, the K spokes 32 have the same size. Alternatively, the K spokes 32 may have the different size from each other. Specifically, when K=3, the sectional areas of the three spokes 32 may be S(1), S(2), and S(3), respectively, and the radial direction length of the three spokes may be L(1), L(2), and L(3), respectively. When more generalized, the identification number for identifying the K spokes 32 is here denoted as n (n is a natural number less than or equal to K, n=1, 2, . . . , K). The sectional area of the K spokes 32 can be expressed by S(n). K values S(n) may be the same value likewise in the first embodiment or may be different from each other. Further, the radial direction length of the K spokes can be expressed by L(n). K values L(n) may be the same value likewise in the first embodiment or may be different from each other.

Similarly, although the P notches NT in the above-described first embodiment all have the same size, alternatively, the P notches NT may have the different size from each other. When generalized, the identification number for identifying P notches NT is here denoted as m (m is a natural number less than or equal to P, m=1, 2, . . . , P). The axial direction length of the P notches NT can be expressed by A(m). P values A(m) may be the same value likewise in the first embodiment or may be different from each other. Further, the circumferential direction length of the P notches NT can be expressed by B(m). P values B(m) may be the same value likewise in the first embodiment or may be different from each other.

Even when the K spokes have different size from each other, a larger total value V1 of the volumes of the K spokes 32 results in a larger force applied to the welding parts WP1 due to the thermal expansion of the K spokes 32. Further, even when the P notches have the different size from each other, a larger total value V2 of the capacities of the notches NT facilitates the bending of the ground electrode 31 and thus allows for a larger degree of the reduction of the thermal stress. Therefore, as described above, it is preferable that V1/V2≤2 is satisfied.

Therefore, when more generalized, it is preferable that the following equation (5) is satisfied, where the number of the spokes is denoted as K (K is a natural number greater than or equal to two), the sectional area of the n-th spoke is denoted as S(n) (n is a natural number less than or equal to K), the radial direction length of the n-th spoke is L(n), the number of the notches is denoted as P (P is a natural number), the axial direction length of m-th notch is denoted as A(m) (m is a natural number less than or equal to P), the circumferential direction length of m-th notch is denoted as B(m), and the radial direction thickness of the ground electrode is denoted as D.

$$\frac{\sum_{n=1}^{K}\{S(n)\times L(n)\}}{\sum_{m=1}^{P}\{A(m)\times B(m)\times D\}} \leqq 2 \tag{5}$$

(3) Also in the above-described second embodiment, the K spokes 32 may have the different size from each other. That is, also in the above-described second embodiment, the sectional area of the K spokes 32 can be expressed by S(n) with the use of the identification number n (n is a natural number less than or equal to K, n=1, 2, . . . , K) for identifying the K spokes 32. The radial direction length of the K spokes can be expressed by L(n).

Similarly, while the P grooves GR in the above-described second embodiment all have the same size, alternatively, the P grooves GR may have the different size from each other. When generalized, the identification number for identifying the P grooves GR is denoted as m (m is a natural number less than or equal to P, m=1, 2, . . . , P). The circumferential direction length of the P grooves GR can be expressed by F(m). The P values F(m) may be the same value likewise in the second embodiment or may be different from each other. Further, the radial direction depth of the P grooves GR can be expressed by E(m). The P values E(m) may be the same value likewise in the second embodiment or may be different from each other.

Even when the K spokes have the different size from each other, a larger total value V1 of the volumes of the K spokes 32 results in a larger force applied to the welding parts WP1 by the thermal expansion of the K spokes 32. Further, even when the P grooves GR have the different size from each other, a larger index value V3 facilitates the bending of the ground electrode 31B and thus allows for a larger degree of the reduction of the thermal stress. Therefore, as described above, it is preferable that V1/V3≤8 is satisfied. The axial direction length H of the spoke 32 used in calculating the index value V3 may also be different for each spoke 32. In this case, the average value of the K spokes 32 may be used in the calculation of the index value V3, where the axial direction length of the spoke 32 is defined to be H.

Therefore, when more generalized, it is preferable that the following equation (6) is satisfied, where the number of the spokes is denoted as K (K is a natural number greater than or equal to two), the sectional area of the n-th spoke is denoted as S(n) (n is a natural number less than or equal to K), the radial direction length of the n-th spoke is L(n), the average value of the axial direction length of the K spokes is denoted as H, the number of the grooves is denoted as P (P is a natural number), the circumferential direction length of m-th groove is denoted as F(m) (m is a natural number less than or equal to P), the radial direction depth of m-th groove is denoted as E(m), and the radial direction thickness of the ground electrode is denoted as D.

$$\frac{\sum_{n=1}^{K}\{S(n)\times L(n)\}}{\sum_{m=1}^{P}[\{H\times E(m)\times F(m)\}\times(E(m)/D)]} \leqq 8 \tag{6}$$

Figure 8A:
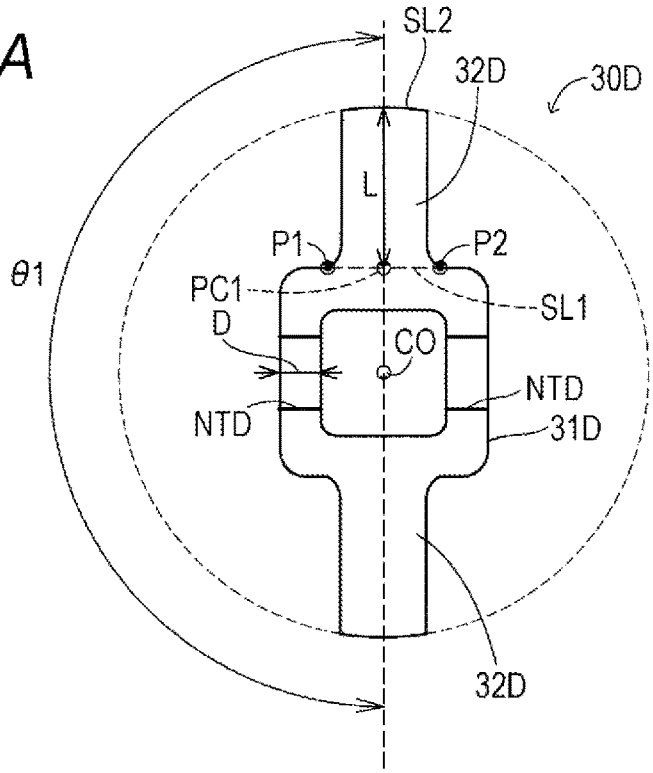
FIGS. 8A and 8B are views illustrating insertion members 30D and 30E of modified examples.
Figure 8B:
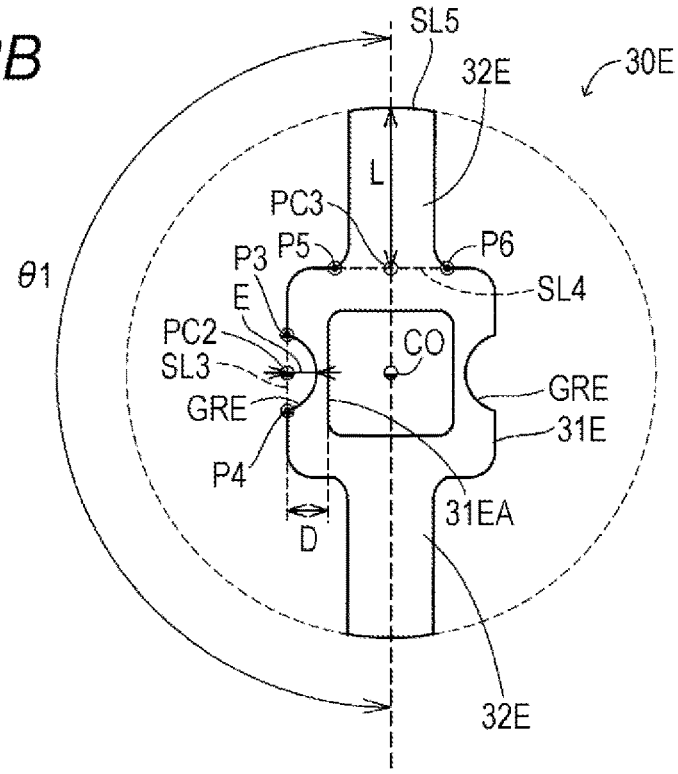

(4) In each of the above-described embodiments, although the ground electrode 31 has substantially the cylindrical shape, the shape is not limited to it. The ground electrode 31 may not have the cylindrical shape. FIGS. 8A and 8B include views illustrating the insertion members 30D and 30E of the modified examples. FIG. 8A and FIG. 8B are views of the insertion members 30D and 30E of the modified examples viewed from the rear end side, respectively. The insertion member 30D of FIG. 8A has two spokes 32D and a ground electrode 31D having a polygonal cylindrical shape whose cross section orthogonal to the axial line CO is substantially a square. In this case, since the number of the spokes 32D is two, the angle θ1 between two spokes 32D is 180 degrees.

In the front end part of the ground electrode 31D, two notches NTD are formed at positions that are different from the positions in the circumferential direction to which the two spokes 32D are connected. As such, when the shape of the ground electrode 31D is not a cylinder, the thickness D of the ground electrode 31D in the portion where the notch NTD is formed cannot be expressed by using the diameter difference (D=(R2−R1)/2) as in the first embodiment. In this case, the thickness D of the ground electrode 31D in the front end side portion at the position where the notch NT is formed is used as the thickness D of the ground electrode 31D in calculating whether or not the above-described equation (5) is satisfied. Further, the radial direction length L of the spoke 32D also cannot be expressed by the diameter difference (L=(R3−R2)/2) as in the first embodiment. In this case, two points are defined as P1 and P2 at which two side surfaces of the spoke 32D are connected to the side surface of the ground electrode 31D as seen from the rear end side along the axial line CO (FIG. 8A). Then, the radial direction length from a middle point PC1 of a virtual line segment SL1 between the two points P1 and P2 to an outer end SL2 in the radial direction of the spoke 32D is used as the radial direction length L of the spoke 32D in calculating whether or not the above-described equation (5) is satisfied.

Similarly to the insertion member 30D of FIG. 8A, the insertion member 30E of FIG. 8B has two spokes 32E and a ground electrode 31E having a polygonal cylindrical shape whose cross-section orthogonal to the axial line CO is substantially a square. In the side surface of the ground electrode 31D, two grooves GRE are formed at positions that are different from the positions in the circumferential direction to which the two spokes 32E are connected. As such, when the shape of the ground electrode 31E is not a cylinder, the thickness D of the ground electrode 31E in the portion where the groove GRE is formed cannot be expressed by using the diameter difference (D=(R2−R1)/2) as in the second embodiment. In this case, as seen from the rear end side along the axial line CO (FIG. 8B), two points located at the edges of the grooves GRE on the side surface of the ground electrode 31E are defined as P3 and P4. Then, the radial direction length between a middle point PC2 of a virtual line segment SL3 between the two points P3 and P4 and an inner side surface 31EA of the ground electrode 31E is used as the thickness D of the ground electrode 31E in calculating whether or not the above-described equation (6) is satisfied. Further, the radial direction length from the middle point PC2 of the virtual line segment SL3 to the bottom part of the groove GRE is used as the radial direction depth E of the groove GRE in calculating whether or not the above-described equation (6) is satisfied.

Further, the radial direction length L of the spoke 32E cannot be expressed by the diameter difference (L=(R3−R2)/2) as in the above-described second embodiment. In this case, two points are defined to be P5 and P6 at which the side surface of two spokes 32E and the side surface of the ground electrode 31D are connected. Similarly to the spoke 32D of the insertion member 30D of FIG. 8A described above, the radial direction length from a middle point PC3 of a virtual line segment SL4 between the two points P5 and P6 to an outer end SL5 in the radial direction of the spoke 32E is used as the radial direction length L of the spoke 32E in calculating whether or not the above-described equation (6) is satisfied.

(5) The vicinity of the front end (FIG. 2) of the metallic shell 50 of each of the above-described embodiments may be formed of a separate member. Specifically, a portion in the front end side in the mounting screw part 52 of the metallic shell 50 may be formed of a conductive cylindrical member that is a separate member from the metallic shell 50 and welded to the front end of the metallic shell 50. Then, the insertion member 30 may be jointed to that separate conductive cylindrical member. Further, the entirety of the mounting screw part 52 of the metallic shell 50 may be formed of a conductive cylindrical member that is a separate member from the metallic shell 50 and welded to the front end of the metallic shell 50. As can be seen from the above description, in each of the above-described embodiments, the metallic shell 50 corresponds to "conductive member" in the claims and, in the modified example, the entirety of the metallic shell 50 and the conductive cylindrical member welded to the front end of the metallic shell 50 corresponds to "conductive member" in the claims.

(6) The position and the shape of the grooves GR and the notches NT in each of the above-described embodiments are an example and thus not limited thereto. For example, although the notches NT of FIG. 3, FIG. 4A and FIG. 4B are provided to the front end side in the ground electrode 31, they may be provided to the rear end side. Further, the notches NT of FIG. 3, FIG. 4A and FIG. 4B may be provided to both of the front end side and the rear end side of the ground electrode 31. Further, since it is preferable that the position in the axial direction in which the notch NT is formed overlaps the position in the axial direction of the spoke 32, the position and the shape of the notches NT may be properly changed depending on the shape of the ground electrode 31 and/or the position in the axial direction of the spokes 32 with respect to the ground electrode 31. Further, the grooves GR of FIG. 5, FIG. 6A and FIG. 6B may be formed in a part of the area along the axial direction without being formed over the entire length in the axial direction of the ground electrode 31B. The ground electrode may have at least one element of at least one of the grooves and the notches. This allows the ground electrode 31 to be more likely to bend compared to the case with no groove nor no notch, so that the thermal stress due to the thermal expansion of the spokes 32 and/or the ground electrode 31 can be reduced. As can be seen from the above description, the grooves GR and the notches NT are an example of the buffer part for reducing the thermal stress caused by the thermal expansion.

(7) In each of the above-described embodiments, the spoke 32 of the insertion member 30 has the welding parts WP1 formed by the welding as the joint parts jointed to the inner circumference surface 12A of the metallic shell 50. Alternatively, the spoke 32 and the inner circumference surface 12A of the metallic shell 50 may be joined by a pressurizing, for example. In this case, the outer surface in the radial direction of the spoke 32, which is pressure-welded to the inner circumference surface 12A of the metallic shell 50, corresponds to "joint part" in the claims.

(8) As the material of the electrode base material 21 of the ground electrode 31 and/or the center electrode 20, without limited to the above-described Inconel, various materials may be employed. For example, the electrode base material 21 of the ground electrode 31 and/or the center electrode 20 are not limited to the Inconel, but may be formed by using various materials that are superior in the thermal resistance property such as other nickel alloy, tungsten, and the like. Further, a part of the ground electrode 31 including the gap forming surface 31A may be formed by using the material containing a material different from the Inconel, for example, the material containing a precious metal such as indium, platinum, and the like. Similarly, the entirety of the nose part 25 of the center electrode 20 and/or a part of the nose part 25 including the gap forming surface 25A may be formed by using the material different from the Inconel, for example, the material containing a precious metal such as indium, platinum, and the like.

(9) The specific shape of the front end portion of the spark plug 100 including the insertion member 30 and the center electrode 20 of the first embodiment and the second embodiment described above are an example, and various modifications are possible. The examples thereof will be described below.

In the first embodiment and the second embodiment described above, the outer ends in the radial direction of three spokes 32 are directly jointed to the inner circumference surface 12A of the mounting screw part 52 of the metallic shell 50. Alternatively, the outer ends in the radial direction of three spokes 32 may be connected to a ring-shaped member and the outer surface of the radial direction of that ring-shaped member may be connected to the inner circumference surface 12A of the mounting screw part 52 of the metallic shell 50. That is, the connection part of the insertion member 30 may include a plurality of spokes 32 and the ring member to which the outer ends in the radial direction of the spokes are connected.

In the first embodiment and the second embodiment described above, the front ends of the ground electrodes 31 and 31B protrude in the front end direction D1 with respect to the front-end-side surfaces of the spokes 32 and the rear ends of the ground electrode 31 and 31B protrude in the rear end direction D2 with respect to the rear-end-side surfaces of the spokes 32. Alternatively, the front end of the ground electrodes 31 and/or 31B may be located in the same position in the axial direction as the front-end-side surfaces of the spokes 32, and the rear end only of the ground electrodes 31 and/or 31B may protrude in the rear end direction D2 with respect to the rear-end-side surfaces of the spokes 32. Alternatively, the front end only of the ground electrodes 31 and/or 31B may protrude in the front end direction D1 with respect to the front-end-side surfaces of the spokes 32, and the rear end of the ground electrodes 31 and/or 31B may be located in the same position in the axial direction as the rear-end-side surfaces of the spokes 32.

In the first embodiment and the second embodiment described above, the rear ends of the insertion members 30 and 30B are supported by the front end of the nose part 13 of the insulator 10. Alternatively, the insertion members 30 and/or 30B may be separated from the front end of the nose part 13. For example, a step part may be formed in the inner circumference surface 12A of the mounting screw part 52 of the metallic shell 50. For example, the mounting screw part 52 may have a rear-end-side portion having a first inner diameter and a front-end-side portion having a second inner diameter that is larger than the first inner diameter, and the step part is formed at the connection portion of the rear-end-side portion and the front-end-side portion. Further, the outer end parts in the radial direction of the spokes 32 of the insertion members 30 and/or 30B may be supported by that step part and thus the insertion members 30 and/or 30B may be arranged separated from the front end of the nose part 13. Further, the insertion members 30 and/or 30B may have the above-described ring member and that ring member may be supported by that step part.

In the first embodiment and the second embodiment described above, the nose part 13 of the insulator 10 has a cylindrical shape. Alternatively, the nose part 13 may have the outer diameter which decreases from the rear end side toward the front end direction D1.

On the front end of the metallic shell 50 of the first embodiment and the second embodiment described above, a cap member having one or more through holes may be arranged. In this case, the insertion members 30 and 30B and the center electrode 20 described above are arranged in the space inside the spark plug 100 formed by the inner circumference surface 12A of the mounting screw part 52 of the metallic shell 50 and the cap member.

As set forth, while the present invention has been described based on the embodiments and the modified examples, the above-described forms of implementing the invention are intended to facilitate the understanding of the present invention and not intended to limit the present invention. The present invention can be modified and/or improved without departing from the spirit thereof and the scope of the claims, and its equivalents are included in the present invention.

DESCRIPTION OF REFERENCE NUMERALS

5 Gasket
6 Annular member
8 Plate packing
8A, 8B Conductive seal
9 Talc
10 Insulator
20 Center electrode
23 Head part
24 Flange part
25 Nose part
30, 30B, 30C Insertion member
31, 31B, 31C Ground electrode
32 Connection part
40 Terminal metal shell
50 Metallic shell
100 Spark plug
311, 311C Front end part
315, 315C Cylindrical part
32 Spoke
GR Groove
NT Notch
WP1, WP2 Welding part

The invention claimed is:

1. A spark plug comprising:

an insulator having an axial hole extending in an axial direction;

a cylindrical conductive member disposed around the insulator;

a center electrode disposed inside the axial hole of the insulator, having a bar shape extending in the axial direction, and located on a rear end side with respect to a front end of the conductive member;

a ground electrode forming a spark gap between the ground electrode and the center electrode; and a connection part including a plurality of spokes extending in a radial direction of an axis whose inner ends are connected to an outer surface of the ground electrode, and connecting the conductive member to the ground electrode, wherein the connection part includes a joint part that is jointed to an inner surface of the conductive member, the ground electrode has at least one of a notch and a groove on the outer surface thereof at a position that is different from a position connected to the plurality of spokes in a circumferential direction of the axis, and the ground electrode has a cylindrical part that continuously extends over an entire circumference in the circumferential direction.

2. The spark plug according to claim 1, wherein the ground electrode has the notch, and the notch and at least one of the spokes are disposed on a particular plane orthogonal to the axial direction, respectively.

3. The spark plug according to claim 1, wherein the ground electrode has the notch, and the notch is longer than half a length of the spoke in the axial direction.

4. The spark plug according to claim 1, wherein the ground electrode has the notch, and an equation (1)

$$\frac{\sum_{n=1}^{K}\{S(n)\times L(n)\}}{\sum_{m=1}^{P}\{A(m)\times B(m)\times D\}} \leqq 2 \quad (1)$$

is satisfied, where the number of the spokes is denoted as K (K is a natural number greater than or equal to 2), a sectional area when an n-th spoke of the spokes is cut by a plane orthogonal to the radial direction is denoted as S(n) (n is a natural number less than or equal to K), and a length in the radial direction of the n-th spoke is denoted as L(n), the number of the notches is denoted as P (P is a natural number), a length in the axial direction of an m-th notch of the notches is denoted as A(m) (m is a natural number less than or equal to P), and a length in the circumferential direction of the m-th notch is denoted as B(m), and a thickness in the radial direction of the ground electrode is denoted as D.

5. The spark plug according to claim 1, wherein the ground electrode has the groove, and the groove extends along the axial direction from a front end to a rear end of the ground electrode.

6. The spark plug according to claim 1, wherein the ground electrode has the groove, and an equation (2)

$$\frac{\sum_{n=1}^{K}\{S(n)\times L(n)\}}{\sum_{m=1}^{P}[\{H\times E(m)\times F(m)\}\times(E(m)/D)]}\leqq 8 \quad (2)$$

is satisfied, where the number of the spokes is denoted as K (K is a natural number greater than or equal to 2), a sectional area when an n-th spoke of the spokes is cut by a plane orthogonal to the radial direction is denoted as S(n) (n is a natural number less than or equal to K), a length in the radial direction of the n-th spoke is denoted as L(n), an average value of lengths in the axial direction of the K spokes is denoted as H, the number of grooves is denoted as P (P is a natural number), a length in the circumferential direction of an m-th groove of the grooves is denoted as F(m) (m is a natural number less than or equal to P), and a depth in the radial direction of the m-th groove is denoted as E(m), and a thickness in the radial direction of the ground electrode is denoted as D.

7. The spark plug according to claim 1, wherein the joint part is formed by welding to the conductive member.

8. The spark plug according to claim 1, wherein the ground electrode includes a portion having a cylindrical shape.

9. The spark plug according to claim 1, wherein the ground electrode includes a portion that is formed of a material whose thermal expansion coefficient is higher than that of the conductive member.

10. The spark plug according to claim 1, wherein the ground electrode includes a portion made of a nickel alloy.

11. The spark plug according to claim 1, wherein an angle formed between any of two spokes adjacent each other in the circumferential direction is less than or equal to 180 degrees.

12. A spark plug comprising:

an insulator having an axial hole extending in an axial direction;

a cylindrical conductive member disposed around the insulator;

a center electrode disposed inside the axial hole of the insulator, having a bar shape extending in the axial direction, and located on a rear end side with respect to a front end of the conductive member;

a ground electrode forming a spark gap between the ground electrode and the center electrode; and a connection part including a plurality of spokes extending in a radial direction of an axis whose inner ends are connected to an outer surface of the ground electrode, and connecting the conductive member to the ground electrode, wherein the connection part includes a joint part that is jointed to an inner surface of the conductive member, the ground electrode has a buffer part on the outer surface thereof that reduces a thermal stress caused by thermal expansion, and the ground electrode has a cylindrical part that continuously extends over an entire circumference in a circumferential direction of the axis.

13. The spark plug according to claim 1, wherein the spark gap is formed between an inner surface of the cylindrical part and an outer surface of the center electrode.

14. The spark plug according to claim 12, wherein the spark gap is formed between an inner surface of the cylindrical part and an outer surface of the center electrode.

* * * * *